United States Patent [19]

Ozaki et al.

[11] Patent Number: 4,761,361

[45] **Date of Patent: * Aug. 2, 1988**

[54] METHOD FOR FORMING AN IMAGE EMPLOYING ACETYLENE SILVER COMPOUNDS

[75] Inventors: Hiroyuki Ozaki; Hiroyuki Hirai; Ken Kawata, all of Kanagawa, Japan

[73] Assignee: Fuji Photo Film Co., Ltd., Minami-ashigara, Japan

[ * ] Notice: The portion of the term of this patent subsequent to Dec. 16, 2003 has been disclaimed.

[21] Appl. No.: 895,063

[22] Filed: Aug. 11, 1986

[30] Foreign Application Priority Data

Aug. 15, 1985 [JP] Japan ..... 60-179959

[51] Int. Cl.[4] ..... G03C 5/54

[52] U.S. Cl. ..... 430/203; 430/619

[58] Field of Search ..... 430/203, 618, 619

[56] References Cited

U.S. PATENT DOCUMENTS 4,629,684 12/1986 Sato et al. ..... 430/203

OTHER PUBLICATIONS

U.S. Ser. No. 846,449, filed Mar. 31, 1986, Hirai et al.

*Primary Examiner*—Richard L. Schilling

*Attorney, Agent, or Firm*—Sughrue, Mion, Zinn, Macpeak & Seas

[57] ABSTRACT

A method for forming an image comprising heating a light-sensitive material comprising a support having thereon at least a light-sensitive silver halide, a dye providing substance, a binder, and an acetylene silver compound, simultaneously with or after imagewise exposure thereof in the presence of water and at least one of a base and a base precursor, thereby transferring a diffusible dye thus formed or released to a dye fixing layer.

25 Claims, No Drawings

METHOD FOR FORMING AN IMAGE EMPLOYING ACETYLENE SILVER COMPOUNDS

FIELD OF THE INVENTION

The present invention relates to a method for forming an image using a heat-developable light-sensitive material containing an organic silver compound.

BACKGROUND OF THE INVENTION

Heat-developable photographic light-sensitive material and methods for forming images using such materials are well known and are described in detail, for example, in *Shashin Kogaku no Kiso* (Fundamentals of Photographic Engineering), Corona Co., Ltd., pp. 553 to 555 (1979), *Eizo Joho* (Image Information) (April 1978), p. 40, and *Neblette's Handbook of Photography and Reprography,* 7th Ed., Van Nostrand Reinhold Company, pp. 32 to 33 (1977), U.S. Pat. Nos. 3,152,904, 3,301,678, 3,392,020 and 3,457,075, British Pat. Nos. 1,131,108 and 1,167,777, and *Research Disclosure,* RD No. 17029, pp. 9 to 15 (June 1978), etc.

Typical examples of organic silver compounds which can be used in heat-developable light-sensitive materials include silver salts of aliphatic carboxylic acids and silver salts of aromatic carboxylic acids.

Further examples include silver salts of aliphatic carboxylic acids having a thioether group, as described in U.S. Pat. No. 3,330,663.

However, these silver salts of carboxylic acids are disadvantageous in that they release acids after reacting with reducing agents to reduce the pH in the layer, and thus subsequent development is restrained.

Organic silver salts other than silver salts of carboxylic acids include silver salts of compounds having a mercapto group, or a thione group, and derivatives thereof.

Additional examples include silver salts of compounds having an imino group such as silver salts of benzotriazole or derivatives thereof, etc., as described in Japanese Patent Publication Nos. 30270/69 and 18416/70.

However, these silver salts are disadvantageous in that they release a compound which restrains development, or, in some cases, causes fog after reacting with reducing agents. Furthermore, they sometimes inhibit the functions of spectral sensitizing dyes, and high sensitivity cannot be obtained.

Moreover, in view of shortening processing time, a method wherein a step for forming imagewise mobile dyes by heating and a step for transferring the mobile dyes to a dye fixing layer are carried out at the same time has been as described, for example, in Japanese Patent Application (OPI) No. 218443/84, etc. (the term "OPI" as used herein refers to a "published unexamined Japanese patent application"). However, it has been desired to provide a more rapid process.

SUMMARY OF THE INVENTION

Therefore, an object of the present invention is to provide a method for forming an image upon which an image having a high density and low fog is obtained in a short period of time.

Other objects of the present invention will become apparent from the following detailed description and examples.

These objects of the present invention are accomplished by a method for forming an image which comprises heating a light-sensitive material comprising a support having thereon at least a light-sensitive silver halide, a dye providing substance, a binder, and an acetylene silver compound simultaneously with or after imagewise exposure thereof in the presence of water and at least one of a base and a base precursor, thereby transferring a diffusible dye thus formed or released to a dye fixing material.

DETAILED DESCRIPTION OF THE INVENTION

In accordance with the method of forming an image of the present invention, the light-sensitive material is heated simultaneously with or after image-wise exposure in the presence of water, and at least one of a base and a base precursor (also referred to herein as base and/or base precursor), and thereby a diffusible dye thus formed or released is transferred to a dye fixing layer. In this case, the light-sensitive material comprises a support having thereon at least a light-sensitive silver halide, a dye providing substance, a binder and an acetylene silver compound.

The dye fixing layer which is used in the present invention can be provided in the light-sensitive material having a light-sensitive layer or can be provided in a material which is prepared separately from the light-sensitive material.

In the method of the present invention, water can be supplied to the dye fixing material or the light-sensitive material. Alternatively, water may be supplied to both the dye fixing material and the light-sensitive material.

In the present invention, water can be supplied by any method. For example, water may be supplied by a jet from small orifices or by a web roller. Further, water may be supplied by rupture of a pod containing water. The method of supplying water is not restricted thereto. Moreover, water may be incorporated into the material in the form of water of crystallization or microcapsules.

The water which can be used in the present invention is not only limited to so-called "pure water" but also includes water which means water widely and customarily employed. Further, an aqueous solution containing a base and/or base precursor as described hereinafter. Moreover, a mixture of a solvent having a low boiling point such as methanol, dimethylformamide, acetone, diisobutyl ketone, etc. with water can be used. Further, an aqueous solution containing a dye releasing assistant, an accelerator, a hydrophilic thermal solvent, etc., as described hereinafter may be employed.

The amount of water used in the present invention is at least 0.1 times of the total weight of the coated layers in the light-sensitive material and the dye fixing material, and preferably in a range from 0.1 times the total weight of the coated layers to the weight of water corresponding to the maximum swelling volume of the whole coated layers. It is more preferred to select the amount in a range from 0.1 time of the total weight of the coated layers to a value obtained by subtracting the total weight of the coated layers from the weight of water corresponding to the maximum swelling volume of all coated layers.

Since the condition of the layers at the swelling is unstable, there is the possibility of occurrence of local ooze. In order to avoid such a problem, it is desirable to control the amount of water under the level corresponding to the maximum swelling volume of the whole coated layers in the light-sensitive material and the dye fixing material. However, the effects of the present invention are equally achieved in a case where a larger amount of water than the above described amount is used compared to the case where the above described desirable range of water is employed, except for being accompanied by the above described problem.

Since development by heating is utilized in the method of the present invention, the development can be conducted at a pH much lower than that of a layer at development of a so-called color diffusion transfer process wherein the development is carried out by spreading a developing solution in a film unit at about normal room temperature (e.g., 25° C.). To elevate the pH is rather disadvantageous because a severe increase of fog accompanies very high pH values. Therefore, the pH of the light-sensitive layer at the time of heating for development and transfer of dye is preferably 12 or less and particularly from 11 or less to a neutral range.

A binder which forms a coated layer in the present invention can be any of those capable of conducting water transfer. The coated layer may contain a light-sensitive silver halide, a dye providing substance, a mordant, an organic solvent having a high boiling point, etc. The relationship of the present invention is realized in the same manner when such additives are present.

The maximum swelling volume is obtained in the following manner. The light-sensitive material or the dye fixing material having a coated layer to be measured is immersed in water which is used, and after being sufficiently swollen a length of a section of the material is measured by means of a microscope, etc. to determine a thickness of the layer. The maximum swelling value is obtained by multiplying the thickness of the layer by the area of the coated layer of the light-sensitive material or the dye fixing material to be measured.

The method of measuring the degree of swelling is described in *Photographic Science and Engineering,* Vol. 16, page 449 (1972).

The degree of swelling is widely varied depending on the extent of hardening. Ordinarily, the extent of hardening is adjusted so that the thickness of a layer at the maximum swelling is in a range of from twice to six times of a thickness of a dry layer.

In order to obtain an image of good quality, the binder used in the present invention is preferably used in an amount of from 1 to 50 g per 1 $m^2$ of the total area of the light-sensitive material and the dye fixing material, more preferably in an amount of from 2 to 35 g, particularly preferably from 3 to 25 g.

In the photographic light-sensitive material according to the present invention, the photographic emulsion layer and other hydrophilic colloid layers may contain an inorganic or organic hardener. It is possible to use a chromium salt (e.g., chromium alum, chromium acetate, etc.), an aldehyde (e.g., formaldehyde, glyoxal, glutaraldehyde, etc.), an N-methylol compound (e.g., dimethylolurea, methylol dimethylhydantoin, etc.), a dioxane derivative (e.g., 2,3-dihydroxydioxane, etc.), an active vinyl compound (e.g., 1,3,5-triacryloylhexahydro-s-triazine, 1,3-vinylsulfonyl-2-propanol, etc.), an active halogen compound (e.g., 2,4-dichloro-6-hydroxy-1,3,5-triazine, etc.), a mucohalogenic acid (e.g., mucochloric acid, mucophenoxychloric acid, etc.), etc., which are used individually or as a combination thereof.

The base and/or base precursor which can be employed in the present invention can be incorporated into the light-sensitive material. Alternatively, it may be incorporated into the dye fixing material which contains the dye fixing layer when the dye fixing layer is provided separately from the light-sensitve material. Further, it may be employed in the form of a solution thereof dissolved in water used in the present invention.

Examples of bases which can be used in the present invention include an inorganic base, for example, a hydroxide, a secondary or tertiary phosphate, a borate, a carbonate, a quinolinate or a metaborate of an alkali metal or an alkaline earth metal; an ammonium hydroxide; a hydroxide of a quaternary alkyl ammonium; a hydroxide of other metals, etc., and an organic base, for example, an aliphatic amine (such as a trialkylamine, a hydroxylamine, an aliphatic polyamine, etc.); an aromatic amine (such as an N-alkyl substituted aromatic amine, an N-hydroxyalkyl substituted aromatic amine, a bis p-(dialkylamino)phenyl methane, etc.); a heterocyclic amine, an amidine, a cyclic amidine, a guanidine, a cyclic guanidine, etc. Among them, those having pKa of 8 or more are preferred.

Further, a salt of the above described organic base and a weak acid, for examsple, a carbonate, a hydrogen carbonate, a borate, a secondary or tertiary phosphate, a quinolinate, an acetate, a metaborate, etc. is preferably used. In addition, the compounds as described in Japanese Patent Application (OPI) No. 218443/84 are preferably employed.

As the base precursor, a compound which releases a base upon a reaction by heating, for example, a salt of an organic acid and a base which decomposes by heating with decarboxylation, a compound which releases an amine upon decomposition with an intramolecular nucleophilic displacement reaction, a Lossen rearrangement reaction or a Beckmann rearrangement reaction, etc., or a compound which generates a base by electrolysis, etc., are preferably employed.

Examples of preferred former type base precursors which release a base by heating include a salt of trichloroacetic acid as described in British Pat. No. 998,949, etc., a salt of α-sulfonylacetic acid as described in U.S. Pat. No. 4,060,420, a salt of a propiolic acid as described in Japanese Patent Application (OPI) No. 180537/84, a 2-carboxycarboxamide derivative as described in U.S. Pat. No. 4,088,496, a salt of a thermally decomposable acid using in addition to an organic base, an alkali metal or an alkaline earth metal as a base component as described in Japanese Patent Application (OPI) No. 195237/84, a hydroxamecarbamate utilizing a Lossen rearrangement as described in Japanese Patent Application (OPI) No. 168440/84, an aldoximecarbamate which forms a nitrile upon heating as described in Japanese Patent Application (OPI) No. 157637/84, etc. Further, base precursors as described in British Pat. No. 998,945, U.S. Pat. No. 3,220,846, Japanese Patent Application (OPI) No. 22625/75, and British Pat. No. 2,079,480, etc., are useful.

Examples of compounds which generate a base by electrolysis include those described below. For example, representative examples of methods using electrolytic oxidation are electrolysis of various salts of fatty acids. According to such a reaction, carbonates of alkali metals or organic bases such as a guanidine, an amidine, etc., can be obtained in extremely high efficiency.

Further, methods using electrolytic reduction include a method of forming an amine by reduction of a nitro or nitroso compound; a method of forming an amine by reduction of nitrile; a method of forming a p-aminophenol, a p-phenylenediamine, a hydrazine, etc., by reduction of a nitro compound, an azo compound, an azoxy compound, etc.; or the like. The p-aminophenols, p-phenylenediamines, and hydrazines can be employed not only as bases but also directly as color image forming substances.

Moreover, it is naturally utilized that alkali components are generated by electrolysis of water in the presence of varous inorganic salts.

The bases and/or base precursors can be employed individually or in combination of two or more thereof.

The base and/or base precursor used in the present invention can be employed in an amount of broad range. It is generally suitably used in an amount of 50% by weight or less, more preferably in a range from 0.01% by weight to 40% by weight, based on the coated amount of a layer to be incorporated, when it is employed in the light-sensitive layer and/or dye fixing layer. Further when it is employed by dissolving it in water used in the present invention, it is preferably used in a concentration from 0.005 mol/l to 2 mol/l, particularly in a concentration from 0.05 mol/l to 1 mol/l. The amount added thereof is not directly related to the pH. When superimposed on the dye fixing material, the base, etc., may move to other layers.

While heating in the method of the present invention, the maximum temperature of the light-sensitive material is decided by the boiling point of the aqueous solution (which is formed by dissolving various additives in water added) in the light-sensitive material, since the light-sensitive material contains a relatively large amount of water which acts as a solvent. The lowest temperature is preferably 50° C. or more. The boiling point of water is 100° C. under normal pressure and water is lost by evaporation when heated at 100° C. or more. Therefore, it is preferred to cover the surface of the light-sensitive material with a water-impermeable material or supply with vapor of high temperature and high pressure. It is advantageous that the temperature of the light-sensitive material is also increased due to the rise of the boiling point of aqueous solution in such cases.

As the heating means, a hot plate, an iron, a hot roller, an exothermic plate utilizing carbon or titanium white, etc., or analogues thereof can be used.

The term "dye images" used in the present invention means multicolor and monocolor dye images. The monocolor dye images include monocolor images composed of a mixture of two or more dyes.

In accordance with the method of forming a dye image of the present invention, diffusible dyes which are formed simultaneously with development in portions corresponding or countercorresponding to silver images can be transferred to the dye fixing layer only by heating simultaneously with or after imagewise exposure of the light-sensitive material in the presence of a small amount of water.

The method of forming an image according to the present invention is explained taking the case of a dye providing substance having a reducing group in the following.

More specifically, according to the method of forming a dye image of the present invention, when the light-sensitive material is imagewise exposed to light and develops by heating in the presence of water, in the case of using, for example, a negative type silver halide emulsion, an oxidation-reduction reaction occurs between an exposed light-sensitive silver halide and a reducing dye providing substance to form a silver image in the exposed area. On the other hand, in this step, the dye providing substance is oxidized to form an oxidation product and consequently a hydrophilic diffusible (mobile) dye is released. As a result, the silver image and the diffusible dye are obtained in the exposed area. The above described reaction is accelerated when a dye releasing assistant is present.

The diffusible dye thus formed is immediately transferred to the dye fixing layer because of the presence of water, whereby a dye image is obtained in a short period of time.

In a case wherein an autopositive type silver halide emulsion is used, the process is the same as in the case of using the negative type silver halide emulsion, except that a silver image and a diffusible dye are obtained in the unexposed area.

Useful examples of the image forming methods using a dye providing substance which forms or releases a diffusible dye in correspondence or countercorrespondence to the reaction in which the light-sensitive silver halide is reduced to silver under a high temperature condition are described in Japanese Patent Application (OPI) Nos. 149046/83, 154445/84, 165054/84 and 180548/84, U.S. Pat. Nos. 4,503,137, 4,474,867, 4,483,914 and 4,455,363, and U.S. patent application Ser. No. 831,675 (filed on Feb. 21, 1986), etc.

In the present invention, the specific method for forming a color image upon heat development comprises the transfer of hydrophilic diffusible dyes. For this purpose, the light-sensitive material according to the present invention is composed of a support having thereon a light-sensitive layer (I) containing at least silver halide, an acetylene silver compound, a reducing agent, and, if desired, a dye providing substance and a binder, and a dye fixing layer (II) capable of receiving the hydrophilic diffusible dye formed in the light-sensitive layer (I).

The above described light-sensitive layer (I) and the dye fixing layer (II) can be formed on the same support, or they can be formed on different supports, separately.

When the light-sensitive layer (I) and the dye fixing layer (II) are formed on the same support, a photographic material containing these layers is defined as a light-sensitive material. When the light-sensitive layer (I) and the dye fixing layer (II) are formed on different supports, a photographic material containing the light-sensitive layer is defined as a light-sensitive material, and a photographic material containing the dye fixing layer is defined as a dye fixing material.

The dye fixing layer (II) may be stripped off the light-sensitive layer (I). For instance, the light-sensitive material is exosed imagewise, developed by heating uniformly and thereafter the dye fixing layer (II) or the light-sensitive layer (I) is peeled apart.

In the case wherein a light-sensitive material having the light-sensitive layer (I) coated on a support and a dye fixing material having the dye fixing layer (II) coated on a support are formed separately, the light-sensitive material is exposed imagewise, superimposed on the dye fixing material and then uniformly heated in the presence of water, whereby the diffusible dyes can be transferred to the dye fixing layer (II).

The dye fixing layer (II) can contain a dye mordant in order to fix the dyes. In the present invention, various mordants can be used, and a polymer mordant is particularly preferred. In addition to the mordant, a base, a base precursor and a thermal solvent, etc., may be incorporated. It is particularly preferred that the base and/or base precursor is incorporated into the dye fixing layer (II), when the light-sensitive layer (I) and the dye fixing (II) are formed on different supports, respectively.

In the present invention, the heat-developable light-sensitive material contains an acetylene silver compound. The acetylene silver compound is mainly represented by formula (I)

$$R-C\equiv C-Ag \quad (I)$$

wherein R represents a substituted or unsubstituted alkyl group, a substituted or unsubstituted cycloalkyl group, a substituted or unsubstituted alkenyl group, a substituted or unsubstituted alkynyl group, a substituted or unsubstituted aralkyl group, a substituted or unsubstituted aryl group, or a substituted or unsubstittued heterocyclic group.

The alkyl group represented by R may be a straight chain or branched chain alkyl group, including, for example, a butyl group, an isobutyl group, a hexyl group, a heptyl group, an octyl group, a dodecyl group, a pentadecyl group, etc. Examples of substituents for the substituted alkyl group include an alkoxy group (for example, a methoxy group, etc.), a hydroxy group, a cyano group, a halogen atom, a sulfonamido group, a carboxylic acid group or a salt thereof, a sulfonic acid group or a salt thereof, a substituted or unsubstituted amino group, an alkynyl group (for example, an ethynyl group, a silver ethynyl group, etc.), etc.

Examples of the cycloalkyl group represented by R include a cyclopentyl group, a cyclohexyl group, a decahydronaphthyl group, etc.

Examples of the alkenyl group represented by R include a propenyl group, an isopropenyl group, a styryl group, etc.

Examples of the alkynyl group represented by R include an ethynyl group, a phenylethynyl group, etc.

Examples of the aryl group represented by R include a phenyl group, a naphthyl group, etc. Examples of substituents for the substituted aryl group include an alkyl group (for example, a methyl group, a dodecyl group, etc.), a cyano group, a hydroxy group, a nitro group, an amino group, an acylamino group, a sulfonamido group (including an aliphatic, aromatic or heterocyclic sulfonamido group), an alkoxy group, an aryloxy group, an alkoxycarbonyl group, a ureido group, a carbamoyl group, an acyloxy group, a heterocyclic group (including a 5-membered or 6-membered heterocyclic group, and preferably a nitrogen-containing heterocyclic group), an alkylsulfonyl group, a carboxylic acid group or a salt thereof, a sulfonic acid group or a salt thereof, a sulfamoyl group, a halogen atom (for example, a fulorine atom, a bromine atom, a chlorine atom, an iodine atom), a substituted or unsubstituted alkynyl group (for example, an ethynyl group, a silver ethynyl group, etc.), etc.

Examples of the aralkyl group represented by R include a benzyl group, etc.

Examples of the heterocyclic group represented by R include a pyridil group, etc.

In the compound represented by formula (I), a bond between the acetylene compound and silver may be either a sigma ($\sigma$) bond or a pi ($\pi$) bond.

Of the acetylene silver compounds according to the present invention, those represented by formula (I) wherein R represents a phenyl group or a substituted phenyl group are preferred.

Specific examples of the acetylene silver compounds used in the present invention are set forth below, but the present invention should not be construed as being limited thereto.

(1)

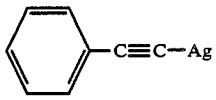

(2)

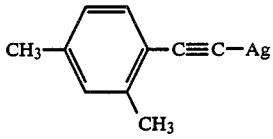

(3)

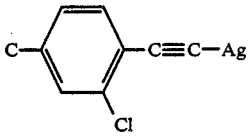

(4)

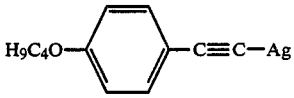

(5)

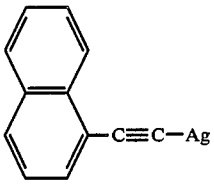

(6)

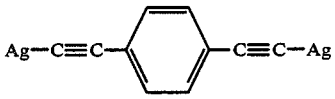

(7)

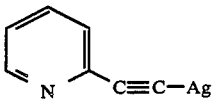

(8)

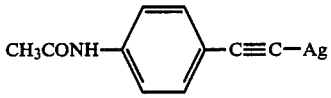

(9)

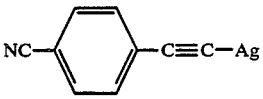

(10)

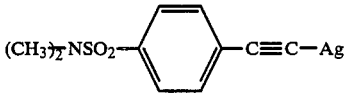

(11)

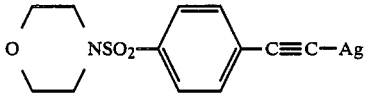

-continued
(12)
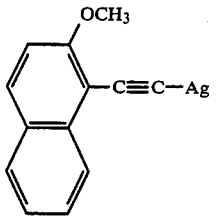
(13)
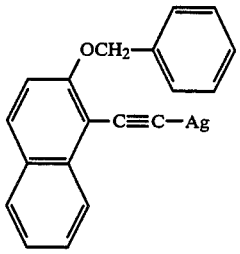
(14)
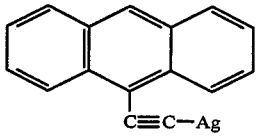
(15)
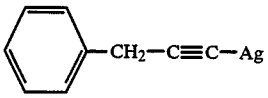
(16)
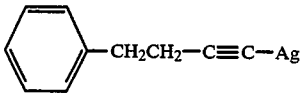
(17)
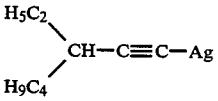
(18)
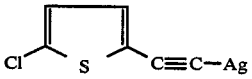
(19)
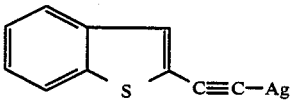
(20)
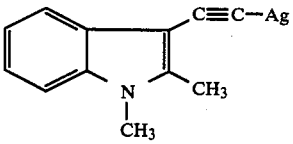
(21)
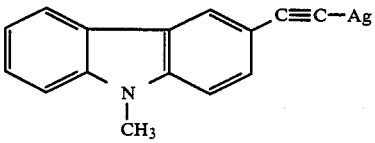
-continued
(22)
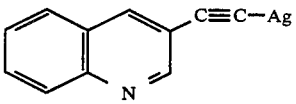
(23)
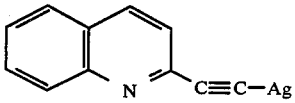
(24)
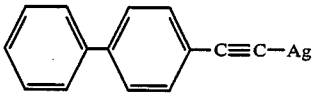
(25)
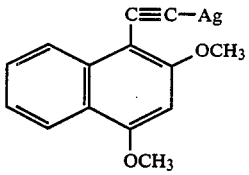
(26)
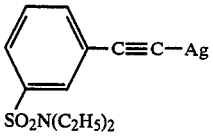
(27)
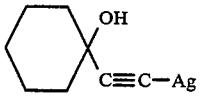
(28)
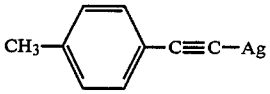
(29)
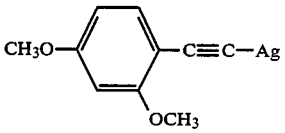
(30)
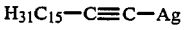
(31)
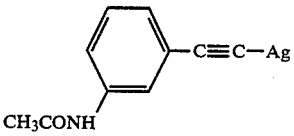
(32)
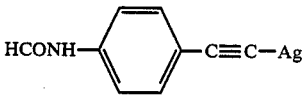
(33)
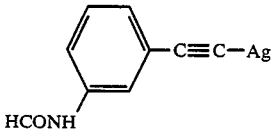

-continued
(34)
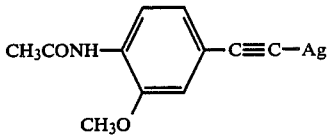
(35)
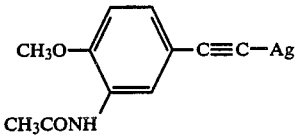
(36)
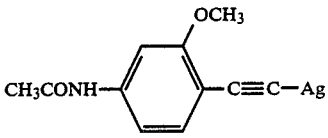
(37)
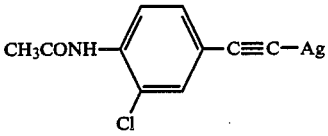
(38)
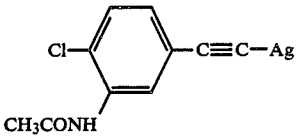
(39)
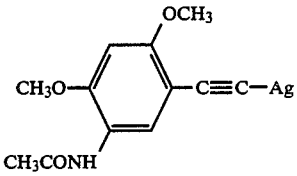
(40)
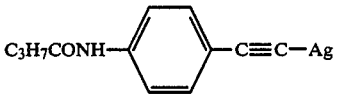
(41)
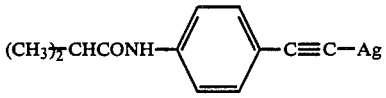
(42)
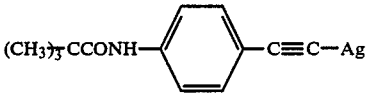
(43)
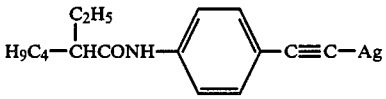
(44)
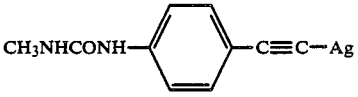
(45)
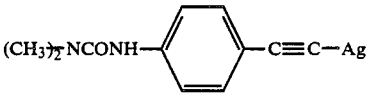
-continued
(46)
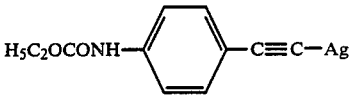
(47)
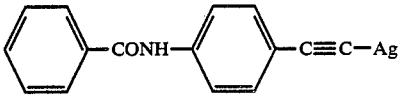
(48)
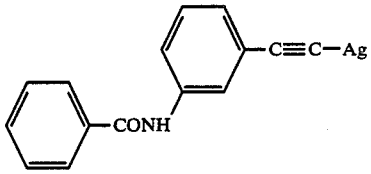
(49)
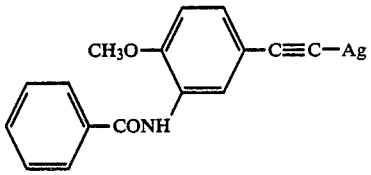
(50)
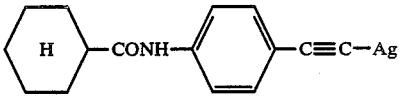
(51)
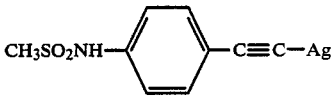
(52)
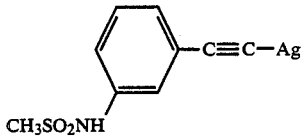
(53)
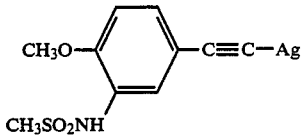
(54)
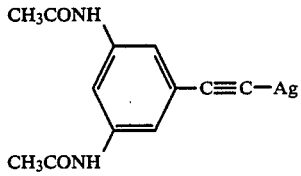
(55)
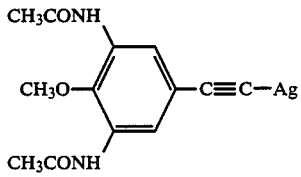
(56)
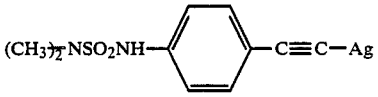

-continued
(57)
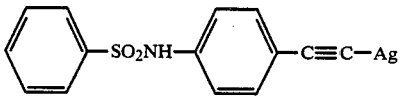
(58)
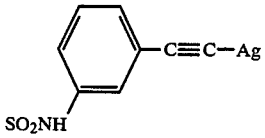
(59)
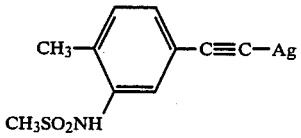
(60)
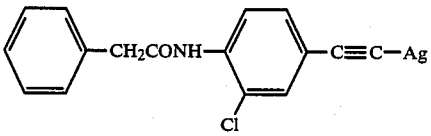
(61)
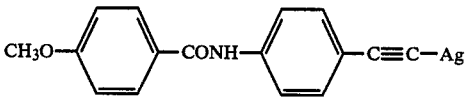
(62)
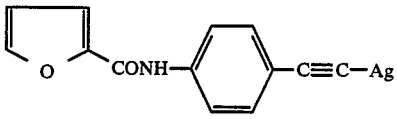
(63)
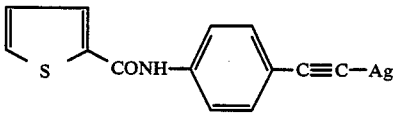
(64)
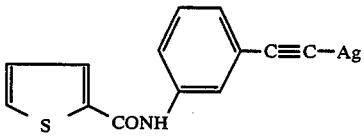
(65)
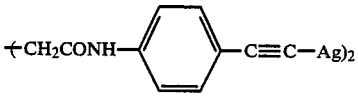
(66)
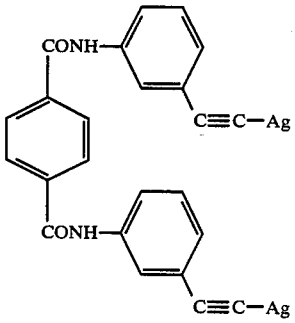
-continued
(67)
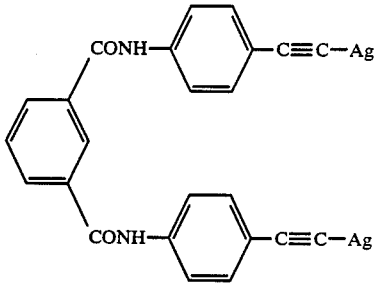
(68)
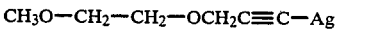
(69)
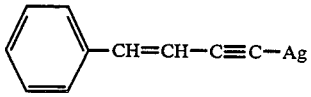
(70)
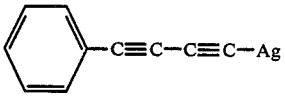
(71)
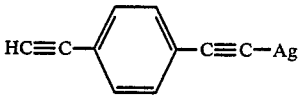
(72)
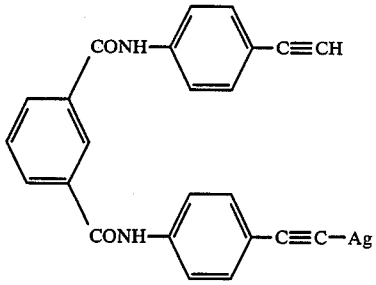
(73)
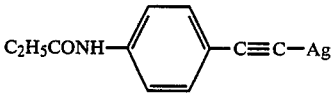
(74)
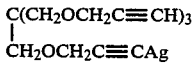
(75)
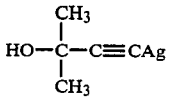
(76)
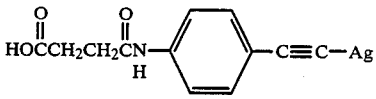
(77)
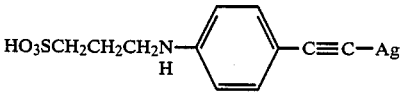
(78)
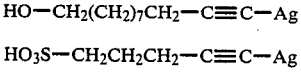
(79)
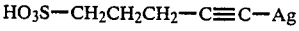

-continued

(80) $HOC(=O)CH_2CH_2CH_2-C\equiv C-Ag$

(81) 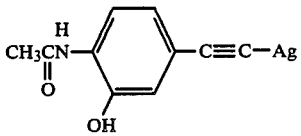

(82) 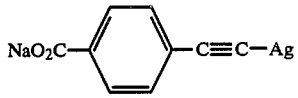

(83) 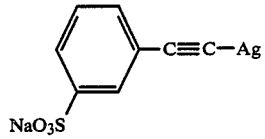

(84) 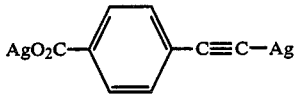

(85) 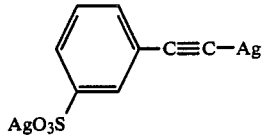

In the following, methods for synthesis of the acetylene silver compound used in the present invention are described. The acetylene silver compound can be obtained simply by mixing a source of silver ion such as silver nitrate and a corresponding acetylene compound in an appropriate solvent, for example, water and/or a hydrophilic solvent such as methanol. In such case, the mixing may be carried out in the presence of a hydrophilic binder such as gelatin. Purification of the resulting product or dispersion can be conducted in a manner well known in the art.

The most general synthesis method of the acetylene silver compound is a dehydrohalogenation of a dihalogenated compound in which two halogen atoms are positioned at vicinal carbon atoms or the same carbon atom or a halogenoolefin with a base. Further, a method using a reaction of a carbonyl compound with phosphorus pentachloride, followed by treatment with a base, a method using a dehalogenation reaction of a 1,2-dihalogenoalkene with zinc, a method using a phosphorus compound, a method utilizing a fragmentation reaction, etc., are well known. Such methods are described in detail, for example, in *Shin-Jikken Kagaku Koza,* Vol. 14 (I), pp. 253 to 306, Maruzen (1977).

Further, the acetylene silver compound according to the present invention may be added in the form of precursor thereof which can be converted to the acetylene silver compound in a light-sensitive material.

The precursor of the acetylene silver compound includes a silver salt of a propiolic acid, a silver salt of a cinnamic acid having a releasing group at the α- or β-position, a silver salt of a benzilidenemalonic acid, and a silver salt of a dihydrocinnamic acid having a releasing group at the β-position, etc.

In the present invention, the acetylene silver compound may be prepared in the same system, namely, together with other components for the heat-developable light-sensitive msaterial in combination, or may be prepared out of the system, namely, separately from the other components for the heat-developable light-sensitive material. However, considering easy control in the case of preparation or ease of storage, it is preferable to prepare it separately from the other components for the heat-developable light-sensitive material.

Two or more kinds of the acetylene silver compounds can be used in the present invention. Further, they can be used together with known organic silver salts. The acetylene silver compound may be used in the same layer containing light-sensitive silver halide or may be used in an adjacent layer thereof in the present invention.

In the present invention, the acetylene silver compound can be employed over a wide range of concentrations. A preferred amount to be coated is in a range from 10 $mg/m^2$ to 10 $g/m^2$, calculated as the amount of silver. Further, the amount thereof is preferably in a range from 0.01 mol to 200 mols per mol of the light-sensitive silver halide.

The shape and particle size of the acetylene silver compound are selected appropriately, but it is preferred that the average particle size is 10 μm or less.

In the present invention, the acetylene silver compound can be used together with known organic silver salts.

Examples of organic compounds which can be used for forming the organic silver salt include an aliphatic or aromatic carboxylic acid, a compound containing a mercapto group or a thiocarbonyl group having an α-hydrogen atom, and a compound containing an imino group, etc.

Typical examples of the silver salts of aliphatic carboxylic acids include a silver salt derived from behenic acid, stearic acid, oleic acid, lauric acid, capric acid, myristic acid, palmitic acid, maleic acid, fumaric acid, tartaric acid, Freund's acid, linolic acid, linoleic acid, adipic acid, sebacic acid, succinic acid, acetic acid, butyric acid, and camphoric acid. Also, a silver salt derived from such an aliphatic carboxylic acid substituted with a halogen atom or a hydroxy group, or an aliphatic carboxylic acid having a thioether group, etc. can be used.

Typical examples of the silver salts of aromatic carboxylic acids and other carboxy group-containing compounds include a silver salt derived from benzoic acid, 3,5-dihydroxybenzoic acid, o-methylbenzoic acid, m-methylbenzoic acid, p-methylbenzoic acid, 2,4-dichlorobenzoic acid, acetamidobenzoic acid, p-phenylbenzoic acid, gallic acid, tannic acid, phthalic acid, terephthalic acid, salicylic acid, phenylacetic acid, pyromellitic acid, 3-carboxymethyl-4-methyl-4-thiazoline 2-thione, etc.

Examples of the silver salts of compounds containing a mercapto group or a thiocarbonyl group include a silver salt derived from 3-mercapto-4-phenyl-1,2,4-triazole, 2-mercaptobenzimidazole, 2-mercapto-5-aminothiadiazole, 2-mercaptobenzothiazole, an S-alkyl thioglycolic acid (wherein the alkyl group has from 12 to 22 carbon atoms), a dithiocarboxylic acid such as dithioacetic acid, etc., a thioamide such as thiostearoylamide, etc., 5-carboxyl-1-methyl-2-phenyl-4-thiopyridine, and a mercapto compound such as mercaptotriazine, 2-mercaptobenzoxazole, mercaptooxadiazole, or 3-amino-5-benzylthio-1,2,4-triazole, etc., as described in U.S. Pat. No. 4,123,274, etc.

Typical examples of the silver salts of compounds containing an imino group include a silver salt derived from a benzotriazole or a derivative thereof, as described in Japanese Patent Publication Nos. 30270/69 and 18416/70, for example, benzotriazole, an alkyl substituted benzotriazole such as methylbenzotriazole, etc., a halogen substituted benzotriazole such as 5-chlorobenzotriazole, etc., a carboimidobenzotriazole such as butylcarboimidobenzotriazole, etc., a nitrobenzotriazole as described in Japanese Patent Application (OPI) No. 118639/83, a sulfobenzotriazole, a carboxybenzotriazole or a salt thereof, a hydroxybenzotriazole, etc., as described in Japanese Patent Application (OPI) No. 118638/83, a 1,2,4-triazole or a 1H-tetrazole as described in U.S. Pat. No. 4,220,709, a carbazole, a saccharin, an imidazole, and a derivative thereof, etc.

Moreover, a silver salt as described in *Research Disclosure,* RD No. 17029 (June 1978), and a silver salt of a thermally decomposable carboxylic acid such as phenylpropiolic acid, etc., as described in Japanese Patent Application (OPI) No. 113235/85, are also used in the present invention.

The silver halide which can be used in the present invention may include any of silver chloride, silver bromide, silver iodide, silver chlorobromide, silver chloroiodide, silver iodobromide, and silver chloroiodobromide.

A halogen composition in the silver halide grains may be uniform or the silver halide grains may have a multiple structure in which the composition is different between a surface portion and an inner portion (see Japanese Patent Application (OPI) Nos. 154232/82, 108533/83, 48755/84 and 52237/84, U.S. Pat. No. 4,433,048 and European Pat. No. 100,984, etc.).

Also, a tabular grain silver halide emulsion containing grains having a thickness of 0.5 μm or less, a diameter of at least 0.6 μm and an average aspect ratio of 5 or more (see U.S. Pat. Nos. 4,414,310 and 4,435,499, and West German Patent Application (OLS) No. 3,241,646A1, etc.), and a monodispersed emulsion having a nearly uniform distribution of grain size (see Japanese Patent Application (OPI) Nos. 178235/82, 100846/83 and 14829/83, International Publication No. 83/02338A1, and European Patents 64,412A3 and 83,377A1, etc.) may be used in the present invention.

Two or more kinds of silver halides in which a crystal habit, a halogen composition, a grain size and/or a distribution of grain size, etc., are different from each other may be used in mixture. Further, two or more kinds of mono-dispersed emulsions having different grain size from each other may be employed in mixture to control gradation.

The average grain size of the silver halide used in the present invention is preferably from 0.001 μm to 10 μm, and more preferably from 0.001 μm to 5 μm.

These silver halide emulsions can be prepared by any of an acid process, a neutral process and an ammonia process. Further, a reaction system of soluble silver salts and soluble halogen salts may be any of a single jet process, a double jet process, or a combination thereof. In addition, a reverse mixing process in which silver halide grains are formed in the presence of an excess of silver ions, or a controlled double jet process in which the pAg in the liquid phase is kept constant is also utilized.

Moreover, for the purpose of increase in growth of grains, the concentration of addition, amount of addition and/or speed of addition of silver salts and halogen salts to be added by be raised (see Japanese Patent Application (OPI) Nos. 142329/80 and 158124/80, and U.S. Pat. No. 3,650,757, etc.).

Furthermore, silver halide grains of epitaxial junction type (see Japanese Patent Application (OPI) No. 16124/81, and U.S. Pat. No. 4,094,684, etc.) may be employed.

In the step of formation of silver halide grains used in the present invention, ammonia, an organic thioether derivative as described in Japanese Patent Publication No. 11386/72, or a compound containing sulfur as described in Japanese Patent Application (OPI) No. 144319/78, etc., can be used as a solvent for silver halide.

In a process of the formation or physical ripening of silver halide grains, a cadmium salt, a zinc, salt, a lead salt, or a thallium salt, etc., may be present.

Further, for the purpose of eliminating high-intensity reciprocity failure or low-intensity reciprocity failure, a water-soluble iridium salt such as iridium (III, IV) chloride, ammonium hexachloroiridiate, etc. or a water-soluble rhodium salt such as rhodium chloride, etc., can be used.

Soluble salts may be removed from the silver halide emulsion after precipitate formation or physical ripening, and a noodle washing process or a flocculation process can be used for this purpose.

While the silver halide emulsion may be employed without being subjected to after-ripening, it is usually chemically sensitized. For the chemical sensitization, a sulfur sensitization method, a reduction sensitization method, and a noble metal sensitization method, etc., which is known in the field of emulsions for conventional type photographic light-sensitive materials can be applied alone or in combination therewith. Such a chemical sensitization may be carried out in the presence of a nitrogen-containing heterocyclic compound (see Japanese Patent Application (OPI) Nos. 126526/83 and 215644/83, etc.).

The silver halide emulsion used in the present invention can be that of a surface latent image type in which a latent image is formed mainly on the surface of grains, or that of an internal latent image type in which a latent image is formed mainly in the interior of grains. Further, a direct reversal emulsion in which an internal latent image type emulsion and a nucleating agent are used in a combination may be used. Examples of the internal latent image type emulsions suitable for this purpose are described in U.S. Pat. Nos. 2,592,250 and 3,761,276, Japanese Patent Publication No. 3534/83, and Japanese Patent Application (OPI) No. 136641/82, etc. Preferred examples of the nucleating agents suitably used in combination in the present invention are described in U.S. Pat. Nos. 3,227,552, 4,245,037, 4,255,511, 4,266,031, and 4,276,364, and West German Patent Application (OLS) No. 2,635,316, etc.

The coating amount of the light-sensitive silver halide used in the present invention is in a range of 1 mg/m$^2$ to 10 g/m$^2$ calculated as an amount of silver.

The silver halide used in the present invention can be spectrally sensitized with methine dyes or other dyes. Suitable dyes which can be employed include cyanine dyes, merocyanine dyes, complex cyanine dyes, complex merocyanine dyes, holopolar cyanine dyes, hemicyanine dyes, stytyl dyes, and hemioxonol dyes. Of these dyes, cyanine dyes, merocyanine dyes, and complex merocyanine dyes are particularly useful. Any conventionally utilized nucleus for cyanine dyes is applicable to these dyes as a basic heterocyclic nucleus. That is, a pyrroline nucleus, an oxazoline nucleus, a thiazole nucleus, a selenazole nucleus, an imidazole nucleus, a tetrazole nucleus, a pyridine nucleus. etc., and further, nuclei formed by condensing an alicyclic hydrocarbon ring with these nuclei and nuclei formed by condensing an aromatic hydrocarbon ring with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei may also be substituted.

To merocyanine dyes and complex merocyanine dyes, as nuclei having a ketomethylene structure, 5- or 6-membered heterocyclic nuclei such as a pyrazolin-5-one nucleus, a thiohydrantoin nucleus, a 2-thiooxazolidin-2,4-dione nucleus, a thiazolidin-2,4-dione nucleus, a rhodanine nucleus, a thiobarbituric acid nucleus, etc., may also be applicable.

These sensitizing dyes can be employed individually, and can also be employed in combinations thereof. A combination of sensitizing dyes is often used, particularly for the purpose of supersensitization.

The sensitizing dyes may be present in the emulsion together with dyes which themselves do not give rise to spectrally sensitizing effects, but which exhibit a supersensitizing effect, or materials which do not substantially absorb visible light, but which exhibit a supersenitizing effect. For example, aminostilbene compounds substituted with a nitrogen-containing heterocyclic group (for example, those described in U.S. Pat. Nos. 2,993,390 and 3,635,721, etc.), aromatic organic acid formaldehyde condensates (for example, those described in U.S. Pat. No. 3,743,510, etc.), cadmium salts, azaindene compounds, etc., can be present. The combinations as described in U.S. Pat. Nos. 3,615,613, 3,615,641, 3,617,295, and 3,635,721 are particularly useful.

In order to incorporate the sensitizing dye into a silver halide photographic emulsion, it may be directly dispersed in the silver halide emulsion or it may be dissolved in a solvent such as water, methanol, ethanol, acetone, methyl cellosolve, etc., individually or as a mixture thereof and then the solution is added to the silver halide emulsion. Further, the sensitizing dye can be dissolved in a solvent which is substantially immiscible with water, such as phenoxyethanol, etc., and the solution is then dispersed in water or a hydrophilic colloid, and thereafter the dispersion was added to the silver halide emulsion. Moreover, the sensitizing dye can be mixed with an oleophilic compound such as a dye providing compound, etc., and added simultaneously to the silver halide emulsion.

In the case of using a combination of the sensitizing dyes, these sensitizing dyes may be separately dissolved or a mixture thereof may be dissolved. Furthermore, these sensitizing dyes may be added separately or simultaneously as a mixture to the silver halide emulsion. They may be added together with other additives to the emulsion.

The period for the addition of the sensitizing dye to the silver halide emulsion may be before, during, or after the chemical ripening, or before or after the formation of silver halide grains as described in U.S. Pat. Nos. 4,183,756 and 4,225,666.

The amount added is generally in a range from about $10^{-8}$ mol to about $10^{-2}$ mol per mol of silver halide.

In the present invention, the light-sensitive material contains a compound which forms a diffusible (mobile) dye or releases a diffusible (mobile) dye in correspondence or counter-correspondence to the reaction wherein the light-sensitive silver halide is reduced to silver under a high temperature condition, that is, a dye providing substance.

In the following, the dye providing substance is described in detail.

An example of the dye providing substance which can be used in the present invention is a coupler capable of reacting with a developing agent. A method utilizing such a coupler can form a dye upon a reaction of the coupler with an oxidation product of a developing agent which is formed by an oxidation reduction reaction between the silver salt and the developing agent and is described in many literatures. Specific examples of the developing agents and the couplers are described in greater detail, for example, in T. H. James, *The Theory of the Photographic Process,* Fourth Edition, pp. 291 to 334 and pp. 354 to 361, Macmillan Publishing Co., 1977, Shinichi Kikuchi, *Shashin Kagaku* (Photographic Chemistry), Fourth Edition, pp. 284 to 295, Kyoritsu Shuppan Co., etc.

Another example of the dye providing substance is a dye-silver compound in which an organic silver salt is connected to a dye. Specific examples of the dye-silver compounds are described in *Research Disclosure,* RD No. 16966, pp. 54 to 58 (May 1978), etc.

Still another example of the dye providing substance is an azo dye used in a heat-developable silver dye bleaching process. Specific examples of the azo dyes and the method for bleaching are described in U.S. Pat. No. 4,235,957, *Research Disclosure,* RD No. 14433, pp. 30 to 32 (April 1976), etc.

A further example of the dye providing substance is a leuco dye as described in U.S. Pat. Nos. 3,985,565 and 4,002,617, etc.

A still further example of the dye providing substance is a compound having a function of releasing or diffusing imagewise a diffusible dye.

This type of compound can be represented by the formula (LI)

$$(\text{Dye—X})_n\text{—Y} \qquad \text{(LI)}$$

wherein Dye represents a dye moiety or a dye precursor moiety; X represents a chemical bond or a linking group; Y represents a group having such a property that diffusibility of the compound represented by $(\text{Dye—X})_n$—Y can be differentiated in correspondence or counter-correspondence to light-sensitive silver salts having a latent image distributed imagewise or a group having a property of releasing Dye in correspondence or counter-correspondence to light-sensitive silver salts having a latent image distributed imagewise, diffusibility of Dye released being different from that of the compound represented by $(\text{Dye—X})_n$—Y; and n represents 1 or 2 and when n is 2, two (Dye—X) groups can be the same or different.

Specific examples of the dye providing substance represented by the general formula (LI) include, for example, dye developers in which a hydroquinone type developing agent is connected to a dye component are described in U.S. Pat. Nos. 3,134,764, 3,362,819, 3,597,200, 3,544,545, 3,482,972, etc. Further, substances capable of releasing diffusible dyes upon an intramolecular nucleophilic displacement reaction are described in Japanese Patent Application (OPI) No. 63618/76, etc., and substances capable of releasing diffusible dyes upon an intramolecular rearrangement reaction of an isooxazolone ring are described in Japanese Patent Application (OPI) No. 111628/74, etc.

In any of these processes, diffusible dyes are released or diffused in portions where development does not occur. In contrast, in portions where development occurs there is neither release nor diffusion of dyes.

There has been provided a process in which a dye releasing compound is previously converted to an oxidized form thereof which does not have a dye releasing ability, the oxidized form of the compound is coexistent with a reducing agent or a precursor thereof and after development the oxidized form is reduced with the remaining reducing agent which is not oxidized to release a diffusible dye. Specific examples of dye providing substances which can be used in such a process are described in Japanese Patent Application (OPI) Nos. 110827/78, 130927/79, 164342/81, and 35533/78, etc.

On the other hand, substances capable of releasing diffusible dyes in portions where development occurred are also known. For example, substances capable or releasing diffusible dyes upon a reaction of couplers having diffusible dyes in the releasing groups thereof with oxidation products of developing agents are described in British Pat. No. 1,330,524, Japanese Patent Publication No. 39165/73, U.S. Pat. No. 3,443,940, etc., and substances capable of forming diffusible dyes upon a reaction of couplers having diffusion resistant groups in the releasing groups thereof with oxidation products of developing agents are described in U.S. Pat. No. 3,227,550, etc.

In these processes using color developing agents, one problem that can be severe is that images are contaminated with oxidation decomposition products of the developing agents. Therefore, in order to eliminate such a problem, dye releasing compounds which have reducing property themselves and thus do not need the use of developing agents have been proposed (of course, in the case using such dye releasing compounds, a reducing agent may be co-used for assistance). Typical examples of these dye releasing compounds are illustrated together with the relevant literature in the following. The definitions for the substituents of the formulae set forth below are the same as those described in the cited literatures, respectively.

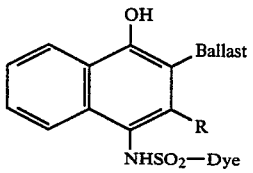

U.S. Pat. No. 3,928,312, etc.

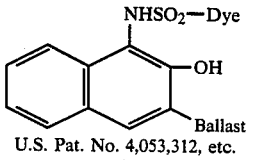

U.S. Pat. No. 4,053,312, etc.

-continued

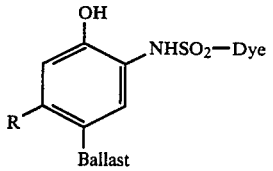

U.S. Pat. No. 4,055,428, etc.

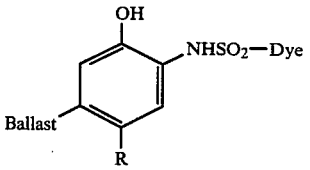

U.S. Pat. No. 4,336,322

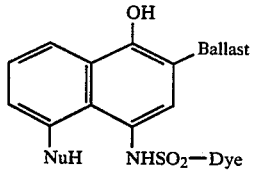

Japanese Patent Application (OPI) No. 65839/84

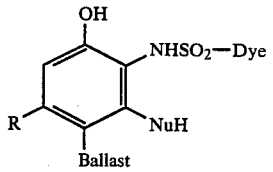

Japanese Patent Application (OPI) No. 69839/84

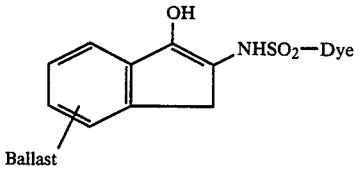

Japanese Patent Application (OPI) No. 3819/78

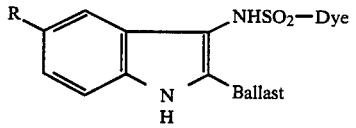

Japanese Patent Application (OPI) No. 104343/76

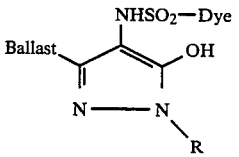

Japanese Patent Application (OPI) No. 104343/76

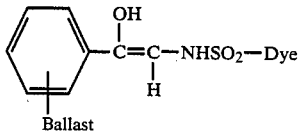

Japanese Patent Application (OPI) No. 104343/76

-continued

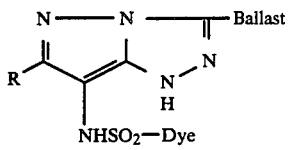

Research Disclosure, RD No. 17465

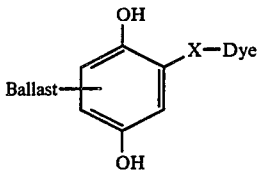

U.S. Pat. No. 3,725,062

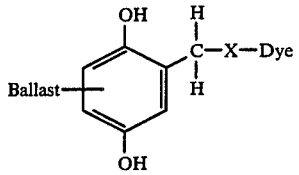

U.S. Pat. No. 3,728,113

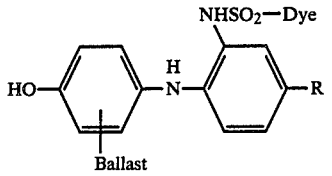

U.S. Pat. No. 3,443,939

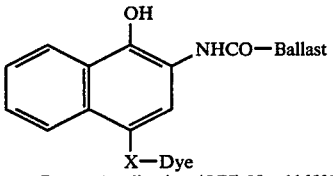

Japanese Patent Application (OPI) No. 116537/83

The dye moiety represented by Dye in the above described formula is preferably derived from azo dyes, azomethine dyes, anthraquinone dyes, naphthoquinone dyes, styryl dyes, nitro dyes, quinoline dyes, carbonyl dyes, and phthalocyanine dyes. Further, the dye moiety may be used in a form temporarily shifted to shorter wave length region or a precursor. Specific examples of the dye moieties released from the dye providing compounds include those described in the above-mentioned Japanese Patent Application (OPI) No. 84236/84, and the chelated dyes as described in Japanese Patent Application (OPI) No. 35533/78.

Any of various dye providing substances described above can be employed in the present invention.

Specific examples of image forming substances used in the present invention are described in the patents and literature mentioned hereinbefore.

The dye providing substance and oil soluble additives such as the image forming accelerator as described below, etc., used in the present invention can introduced into a layer of the light-sensitive material by known methods such as the method described in U.S. Pat. No. 2,322,027. In this case, an organic solvent having a high boiling point or an organic solvent having a low boiling point as described below can be used. For example, the dye providing substance, etc., is dispersed in a hydrophilic colloid after it is dissolved is in an organic solvent having a high boiling point, for example, a phthalic acid alkyl ester (for example, dibutyl phthalate, dioctyl phthalate, etc.), a phosphoric acid ester (for example, diphenyl phosphate, triphenyl phosphate, tricresyl phosphate, dioctylbutyl phosphate, etc.), a citric acid ester (for example, tributyl acetylcitrate, etc.), a benzoic acid ester (for example, octyl benzoate, etc.), an alkylamide, a fatty acid ester (for example, dibutyoxyethyl succinate, dioctyl azelate, etc.), a trimesic acid ester (for example, tributyl trimesate, etc.), etc., or an organic solvent having a boiling point of about 30° C. to 160° C., for example, a lower alkyl acetate such as ethyl acetate, butyl acetate, etc., ethyl propionate, secondary butyl alcohol, methyl isobutyl ketone, $\beta$-ethoxyethyl acetate, methyl cellosolve acetate, cyclohexanone, etc. The above described organic solvents having a high boiling point and organic solvents having a low boiling point may be used as a mixture thereof.

Further, it is possible to use a dispersion method using a polymer as described in Japanese Patent Publication No. 39853/76 and Japanese Patent Application (OPI) No. 59943/76, etc. Moreover, various surface active agents can be used when the type providing substance, etc. is dispersed in a hydrophilic colloid. For this purpose, the surface active agents illustrated in other part of the specification can be used.

An amount of the organic solvent having a high boiling point used in the present invention is 10 g or less, and preferably 5 g or less, per g of the dye providing substance used.

In the case of using compounds which are substantially water-insoluble, they may be incorporated in the light-sensitive material by dispersing as fine particles in a binder, in addition to the above described methods.

In the present invention, it is preferred to incorporate a reducing substance into the light-sensitive material. Examples of the reducing substances include dye providing substances having reducing property as described hereinbefore in addition to substances which are generally known as reducing agents in the art. Further, precursors of reducing agents which do not have reducing property themselves but exhibit reducing property due to action of nucleophilic reagent or heat in the process of development are also included.

Examples of the reducing agents which can be used in the present invention include an inorganic reduction agent such as sodium sulfite, sodium hydrogen sulfite, etc., a benzenesulfinic acid, a hydroxylamine, a hydrazine, a hydrazide, a boran-amine complex, a hydroquinone, an aminophenol, a catechol, a p-phenylenediamine, a 3-pyrazolidinone, a hydroxytetronic acid, an ascorbic acid, a 4-amino-5-pyrazolone, etc. The reducing agents as described in T. H. James, *The Theory of the Photographic Process,* Fourth Edition, pp. 291 to 334 can also be employed. Further, reducing agent precursors as described in Japanese Patent Application (OPI) Nos. 138736/81 and 40245/82, U.S. Pat. No. 4,330,617, etc. may be employed.

Various combinations of developing agents as described in U.S. Pat. No. 3,039,869 can also be used.

In the present invention, an amount of the reducing agent added is from 0.01 mol to 20 mols per mol of silver and more preferably from 0.1 mol to 10 mols per mol of silver.

In the present invention, an image forming accelerator can be used. The image forming accelerator has a function which accelerates the oxidation reduction reaction between a silver salt oxidizing agent and reducing agent, a function which accelerates a reaction of forming a dye, decomposing a dye or releasing a mobile dye from a dye providing substance, etc., or a function which accelerates transfer of a dye from a layer of the light-sensitive material to a dye fixing layer. From the standpoint of a physicochemical function, they are classified into a group, for example, a nucleophilic compound, an oil, a thermal solvent, a surface active agent, a compound having an interaction with silver or a silver ion, etc. However, such groups of substances usually show complex functions and generally exhibit several of the above described accelerating effects at the same time.

The image forming accelerators are classified depending on their function, and specific examples thereof are set forth below. However, such a classification is only for convenience, and in practice one compound is often multi-functional.

(a) Base

Preferred examples of the bases are set forth hereinbefore.

(b) Base precursor

Examples of the base precursors are set forth hereinbefore.

(c) Nucleophilic compound

Examples of the nucleophilic compounds include water, a water releasing compound, an amine, an amidine, a guanidine, a hydroxylamine, a hydrazine, a hydrazide, an oxime, a hydraxamic acid, a sulfonamide, an active methylene compound, an alcohol, a thiol, etc. Further, salts or precursors of the above described compounds may be employed.

(d) Oil

An organic solvents having a high boiling point (so-called plasticizer) which can be used as a solvent for dispersion of a hydrophobic compound is employed.

(e) Thermal solvent

The thermal solvent is a compound which is solid at an ambient temperature and melts at around a development temperature to act as a solvent. Examples of the thermal solvents include compounds which are selected from a urea, a urethane, an amide, a pyridine, a sulfonamide, a sulfone, a sulfoxide, an ester, a ketone, and an ether and which are solid at 40° C. or below.

(f) Surface active agent

Examples of the surface active agents include a pyridinium salt, an ammonium salt, and a phosphonium salt as described in Japanese Patent Application (OPI) No. 74547/84, etc., and a polyalkyleneoxide as described in Japanese Patent Application (OPI) No. 57231/84, etc.

(g) Compound having an interaction with silver or a silver ion

Examples of the compounds include an imide, a nitrogen-containing heterocyclic compound as described in Japanese Patent Application (OPI) No. 177550/84, a thiol, a thiourea, and a thioether as described in Japanese Patent Application (OPI) No. 111636/84, etc.

The image forming accelerator may be incorporated into either the light-sensitive material, the dye fixing material, or both of them. Further, it may be incorporated into any of an emulsion layer, an intermediate layer, a protective layer, an image receiving layer (e.g., a dye fixing layer), and/or a layer adjacent thereto. The above descriptions are true in an embodiment wherein a light-sensitive layer and a dye fixing layer are provided on the same support.

The image forming accelerators may be employed individually or in a mixture of two or more thereof. In general, a great accelerating effect is obtained when two or more kinds of them are employed in mixture. Particularly, when a base or base precursor is employed together with other kinds of the accelerators, a remarkable accelerating effect is revealed.

In the present invention, various kinds of development stopping agents are used for the purpose of obtaining a constant image irrespective of variation in a processing temperature and a processing time at the development.

The term "development stopping agent" used herein means a compound which can rapidly neutralize a base or react with a base to decrease concentration of the base in the layer when the development has appropriately proceeded, whereby the development is stopped or a compound which can interact with silver or a silver salt and inhibit the development.

Examples of the development stopping agents include an acid precursor which releases an acid by heating, an electrophilic compound which causes a displacement reaction with a base coexistent by heating, a nitrogen-containing heterocyclic compound, a mercapto compound, and a precursor thereof, etc.

Examples of the acid precursors include an oxime ester as described in Japanese Patent Application (OPI) Nos. 108837/85 and 192939/85, a compound which releases an acid upon a Lossen rearrangement as described in Japanese Patent Application (OPI) No. 230133/85, etc.

Examples of the electrophilic compounds which cause a displacement reaction with bases by heating include a compound as described in Japanese Patent Application (OPI) No. 230134/85, etc.

Further, the compounds which release a mercapto compound by heating are useful and include those described in U.S. patent application Ser. Nos. 774,427 (filed on Sept. 10, 1985), 809,627 (filed on Dec. 16, 1985), 799,996 (filed on Nov. 20, 1985), 827,139 (filed on Feb. 7, 1986), 829,032 (filed on Feb. 13, 1986), 828,481 (filed on Feb. 12, 1986), etc.

It is preferred that the above described development stopping agent is employed together with the base precursor since its effect better achieved by the combination.

In such a case, a ratio (molar ratio) of a base precursor/and acid precursor is preferably in a range from 1/20 to 20/1, and more preferably in a range from 1/5 to 5/1.

Further, in the present invention, it is possible to use a compound which activates development simultaneously while stabilizing the image. Particularly, it is preferred to use an isothiuronium including 2-hydroxyethylisothiuronium trichloroacetate, etc., as described in U.S. Pat. No. 3,301,678, a bisisothiuronium including 1,8-(3,6-dioxaoctane)bis(isothiuronium trichloroacetate), etc., as described in U.S. Pat. No. 3,669,670, a thiol compound as described in West German Patent Application (OLS) No. 2,162,714, a thiazolium compound such as 2-amino-2-thiazolium trichloroacetate, 2-amino-5-bromoethyl-2-thiazolium trichloroacetate, etc., as described in U.S. Pat. No. 4,012,260, a compound having an α-sulfonylacetate as an acidic component, such as bis(2-amino-2-thiazolium)methylenebis(-sulfonylacetate), 2-amino-2-thiazolium phenylsulfonylacetate, etc., as described in U.S. Pat. No. 4,060,420, etc.

Moreover, an azolethioether and a blocked azolinethione compound as described in Belgian Pat. No. 768,071, a 4-aryl-1-carbamoyl-2-tetrazoline-5-thione compound as described in U.S. Pat. No. 3,893,859, and a compound as described in U.S. Pat. Nos. 3,839,041, 3,844,788, and 3,877,940 are also preferably employed.

In the present invention, various kinds of antifogging agents can be employed. Examples of useful antifogging agents include an azole, a carboxylic acid, and a phosphoric acid each containing a nitrogen atom as described in Japanese Patent Application (OPI) No. 168442/84, a mercapto compound and a metal salt thereof as described in Japanese Patent Application (OPI) No. 111636/84, etc. Such an antifogging agent can be used in a concentration range from 0.001 mol to 10 mols per mol of silver.

In the present invention, image toning agents can be incorporated, if desired. Effective toning agents are compounds such as phthaladinones, 1,2,4-triazoles, 1H-tetrazoles, thiouracils and 1,3,4-thiadiazoles, etc. Examples of preferred toning agents include 5-amino-1,3,4-thiadiazole-2-thiol, 3-mercapto-1,2,4-triazole, bis(dimethylcarbamoyl)disulfide, 6-methylthiouracil and 1-phenyl-2-tetrazoline-5-thione, etc. Particularly effective toning agents are compounds which can form black images.

The concentration of the toning agents incorporated varies depending on the kind of heat-developable light-sensitive material, processing conditions, images to be required, and other factors, but it is generally in a range of about 0.001 mol to 0.1 mol per mol of silver in the light-sensitive material.

The binder which can be used in the present invention can be employed individually or in a combination thereof. A hydrophilic binder can be used as the binder according to the present invention. The typical hydrophilic binder is a transparent or translucent hydrophilic colloid, examples of which include a natural substance, for example, protein such as gelatin, a gelatin derivative, a cellulose derivative, etc., a polysaccharide such as starch, gum arabic, etc., and a synthetic polymer compound, for example, a water-soluble polyvinyl compound such as polyvinyl pyrrolidone, acrylamide polymer, etc. Another example of the synthetic polymer compound is a dispersed vinyl compound in a latex form which is used particularly for the purpose of increasing dimensional stability of a photographic material.

In addition, the compounds as described in *Research Disclosure,* page 26, IXA (December 1978), can be employed.

A suitable coating amount of the binder according to the present invention is 20 g or less, preferably 10 g of less, and more preferably 7 g or less per $m^2$.

A suitable ratio of the organic solvent having a high boiling point which is dispersed in a binder together with a hydrophobic compound such as a dye providing substance to the binder is 1 ml or less, preferably 0.5 ml or less and more preferably 0.3 ml or less per g of the binder.

In the heat-developable light-sensitive material and the dye fixing material according to the present invention, the photographic emulsion layer, the above described electrically conductive layer, the dye fixing layer and other binder layers may contain an inorganic or organic hardener. It is possible to use a chromium salt (e.g., chromium alum, chromium acetate, etc.), an aldehyde (e.g., formaldehyde, glyoxal, glutaraldehyde, etc.), an N-methylol compound (e.g., dimethylolurea, methylol dimethylhydantoin, etc.), a dioxane derivative (e.g., 2,3-dihydroxydioxane, etc.), an active vinyl compound (e.g., 1,3,5-triacryloylhexahydro-s-triazine, 1,3-vinylsulfonyl-2-propanol, 1,2-bis-(vinylsulfonylacetamido)ethane, etc.), an active halogen compound (e.g., 2,4-dichloro-6-hydroxyl-1,3,5-triazine, etc.), a mucohalogenic acid (e.g., mucochloric acid, mucophenoxychloric acid, etc.), etc., which are used individually or as a combination thereof.

A support used in the heat-developable light-sensitive material and the dye fixing material, if desired, according to the present invention is that which can endure at the processing temperature. As an ordinary support, not only glass, paper, metal or analogues thereof may be used, but also an acetyl cellulose film, a cellulose ester film, a polyvinyl acetal film, a polystyrene film, a polycarbonate film, a polyethylene terephthalate film, and a film related thereto or a resin material may be used. Further, a paper support laminated with a polymer such as polyethylene, etc., can be used. A polyester as described in U.S. Pat. No. 3,634,089 and 3,725,070 are preferably used.

When the dye providing substance represented by formula (LI) described above is incorporated into the heat-developable light-sensitive material used in the present invention, since the dye providing substance is colored, it is not so necessary to further incorporate an anti-irradiation or antihalation substance or various dyes in the light-sensitive material. However, in order to increase sharpness of images, a filter dye or an absorbing substance, etc., as described in Japanese Patent Publication No. 3692/73, U.S. Pat. Nos. 3,253,921, 2,527,583, 2,956,879, etc., can be incorporated into the light-sensitive material used in the present invention. It is preferred for such a dye to lose its color upon heating. For example, dyes as described in U.S. Pat. Nos. 3,769,019, 3,745,009, 3,615,432, etc., are preferably employed.

The light-sensitive material which can be used in the present invention may contain, if desired, various additives which are known for use in heat-developable light-sensitive materials, and layers other than the light-sensitive layer, for example, a protective layer, an intermediate layer, an antihalation layer, a stripping layer, etc. Various additives which can be used include those as described in *Research Disclosure,* Vol. 170, RD No. 17029 (June 1978), for example, a plasticizer, a sharpness-improving dye, an antihalation dye, a sensitizing dye, a matting agent, a surface active agent, a fluorescent whitening agent, a color fading prevent agent, etc.

The photographic material according to the present invention may be comprised a light-sensitive layer which forms or releases a dye upon development by heating, and, if desired, a dye fixing layer for fixing a dye. Particularly in a system wherein images are formed by diffusion transfer of dyes, both the light-sensitive layer and the dye fixing layer are essential. Typical photographic materials employed in such a system are divided broadly into two embodiments, that is an embodiment in which the light-sensitive layer and the dye fixing layer are provided on two supports separately and an embodiment in which both layers are provided on the same support.

When the light-sensitive layer and the dye fixing layer are formed on the same support, a photographic material containing these layers is defined as a light-sensitive material. When the light-sensitive layer and the dye fixing layer are formed on different supports, a photographic material containing the light-sensitive layer is defined as a light-sensitive material, and a photographic material containing the dye fixing layer is defined as a dye fixing material.

The embodiment in which the light-sensitive layer and the dye fixing layer are formed on different supports is classified into two types. Specifically one is a peel-apart type, and the other is a non-peel-apart type.

In the case of the former peel-apart type, a coated surface of the light-sensitive material and a coated surface of the dye fixing material are superposed on each other after image exposure or heat development, and then after formation of transferred images the light-sensitive material is rapidly peeled apart from the dye fixing material. A support of the dye fixing material is selected from an opaque support and a transparent support depending on whether the final image is a reflective type or a transmitting type. Further, a white reflective layer may be provided on the support, if desired.

In the case of the latter non-peel-apart type, it is necessary that a white reflective layer is present between a light-sensitive layer of the light-sensitive material and a dye fixing layer of the dye fixing material. The white reflective layer can be provided in either the light-sensitive material or the dye fixing material. In this case, the support of the dye fixing material is appropriately a transparent support.

One representative example of the embodiment in which the light-sensitive layer and the dye fixing layer are provided on the same support is a type in which the light-sensitive layer is not necessary to peel apart from the image receiving (dye fixing) layer after the formation of transferred images. In such a case, on a transparent or opaque support a light-sensitive layer, a dye fixing layer and a white reflective layer are superposed. Examples of preferred embodiments of layer structure include transparent or opaque support/light-sensitive layer/white reflective layer/dye fixing layer, or transparent support/dye fixing layer/white reflective layer/-light-sensitive layer, etc.

Another typical example of the embodiment in which the light-sensitive layer and the dye fixing layer are provided on the same support is a type in which a part or all of the light-sensitive layer is separated from the dye fixing layer and a stripping layer is provided on an appropriate position of the material as described, for example, in Japanese Patent Application (OPI) No. 67840/81, Canadian Pat. No. 674,082, U.S. Pat. No. 3,730,718, etc.

In any of the above embodiments, the light-sensitive material or the dye fixing material may form a structure having an electrically conductive heat generating layer suitable to use as heating means for the purpose of heat development and/or diffusion transfer of dyes.

In order to reproduce a wide range of color in a chromaticity diagram using three elementary colors, i.e., yellow, magenta and cyan, it is necessary that the light-sensitive material used in the present invention contains at least three silver halide emulsion layers, each having its sensitivity in a spectral region different from each other.

Typical examples of the combination of at least three light-sensitive silver halide emulsion layers each having sensitivity in a spectral region different from each other include: a combination of a blue-sensitive emulsion layer, a green-sensitive emulsion layer and a red-sensitive emulsion layer; a combination of a green-sensitive emulsion layer, a red-sensitive emulsion layer and an infrared light-sensitive emulsion layer; a combination of a blue-sensitive emulsion layer, a green-sensitive emulsion layer and an infrared light-sensitive emulsion layer; a combination of a blue-sensitive emulsion layer, a red-sensitive emulsion layer and an infrared light-sensitive emulsion layer, etc. The infrared light-sensitive emulsion layer used herein means an emulsion layer having sensitivity to light in a region of 700 nm or more, and particularly in a region of 740 nm or more.

The light-sensitive material used in the present invention may have two or more light-sensitive emulsion layers which are sensitive to light of the same spectral region but have different sensitivities, if desired.

It is necessary that each of the above described emulsion layer and/or light-insensitive hydrophilic colloid layers adjacent to the emulsion layers contain at least one kind of a dye providing substance capable of releasing or forming a yellow hydrophilic dye, a dye providing substance capable of releasing or forming a magenta hydrophilic dye, and a dye providing substance capable of releasing or forming a cyan hydrophilic dye, respectively. In other words, in each of the emulsion layers and/or light-insensitive hydrophilic colloid layers adjacent to the emulsion layers, dye providing substances capable of releasing or forming hydrophilic dyes having different hues from each other should be incorporated, respectively. If desired, two or more kinds dye providing substances having the same hue may be used in mixture. In case of using dye providing substances which are colored originally, it is particularly advantageous that the dye providing substances are incorporated into layers other than the emulsion layers.

The light-sensitive material used in the present invention may contain, if desired, additional layers, for example, a protective layer, an intermediate layer, an antistatic layer, an anti-curling layer, a stripping layer, a matting layer, etc., in addition to the above described layers.

Particularly, the protective layer (PC) usually contains an organic or inorganic matting agent for the purpose of preventing adhesion. Further, the protective layer may contain a mordant, an ultraviolet ray absorbing agent, etc. The protective layer and the intermediate layer may be composed of two or more layers, respectively.

Moreover, the intermediate layer may contain a reducing agent for preventing color mixing, an ultraviolet ray absorbing agent, a white pigment such as $TiO_2$, etc. The white pigment may incorporate into the emulsion layer in addition to the intermediate layer for the purpose of increasing the sensitivity.

In order to impart the spectral sensitivity as described above to the silver halide emulsion, the silver halide emulsion may be spectrally sensitized using known sensitizing dyes so as to obtain the desired spectral sensitivity.

The dye fixing element which can be used in the present invention comprises at least one layer containing a mordant. When the dye fixing layer is positioned on the surface of the dye fixing element, a protective layer can further be provided in the element, if desired.

Moreover, a water absorbing layer or a layer containing a dye transfer assistant may be provided in order to sufficiently incorporate the dye transfer assistant, if desired, or in order to control the dye transfer assistant. These layers may be provided adjacent to the dye fixing layer or provided through an intermediate layer.

The dye fixing layer used in the present invention may be composed of two or more layers containing mordants which having mordanting powers different from each other, if desired.

The dye fixing element used in the present invention may contain, if desired, a subsidiary layer, for example, a stripping layer, a matting layer, an anti-curling layer, etc., in addition to the above described layers.

Into one or more of the layers described above, a base and/or base precursor for the purpose of accelerating dye transfer, a hydrophilic thermal solvent, a color fading preventing agent for preventing fading of dyes, an ultraviolet ray absorbing agent, a dispersed vinyl compound for the purpose of increasing dimensional stability, a fluorescent whitening agent, etc., may be incorporated.

The binder which can be used in the above described layers is preferably a hydrophilic binder. The typical hydrophilic binder is a transparent or translucent hydrophilic colloid, examples of which include a natural substance, for example, protein such as gelatin, a gelatin derivative, etc., a polysaccharide such as a cellulose derivative, starch, gum arabic, etc., a water soluble polyvinyl compound such as polyvinyl alcohol, polyvinyl pyrrolidone, acrylamide polymer, etc. Among them, gelatin, and polyvinyl alcohol are particularly preferred.

The dye fixing element may have a reflective layer containing a white pigment such as titanium oxide, etc., a neutralizing layer, a neutralization timing layer, etc., in addition to the above described layer depending on the purposes. These layers may provide not only in the dye fixing element, but also in the light-sensitive element. The compositions of these reflective layer, neutralizing layer, and neutralization timing layer are described, for example, in U.S. Pat. Nos. 2,983,606, 3,362,819, 3,362,821 and 3,415,644, Canadian Pat. No. 928,559, etc.

It is advantageous that the dye fixing element according to the present invention contains a transfer assistant as described below. The transfer assistant may be incorporated into the above described dye fixing layer or the other layer.

The dye fixing layer employed in the present invention includes a dye fixing layer which can be used in heat-developable color light-sensitive materials. A mordant to be used can be selected appropriately from mordants conventionally used. Among them, polymer mordants are particularly preferred. The polymer mordants include polymers containing tertiary amino groups, polymers containing nitrogen-containing heterocyclic moieties, and polymers containing quaternary cationic groups thereof, etc.

Specific examples of polymers containing vinyl monomer units having a tertiary amino group are described in Japanese Patent Application (OPI) Nos. 60643/85 and 57836/85, etc. Specific examples of polymers containing vinyl monomer units having a tertiary imidazole group are described in Japanese Patent Application (OPI) Nos. 118834/85 and 122941/85, U.S. Pat. Nos. 4,282,305, 4,115,124, and 3,148,061, etc.

Specific examples of preferred polymers containing vinyl monomer units having a quaternary imidazolium salt are described in British Pat. Nos. 2,056,101, 2,093,041 and 1,594,961, U.S. Pat. Nos. 4,124,386, 4,115,124, 4,273,853 and 4,450,224, Japanese Patent Application (OPI) No. 28225/73, etc.

Specific examples of other preferred polymers containing vinyl monomer units having a quaternary ammonium salt are described in U.S. Pat. Nos. 3,709,690, 3,898,088, and 3,958,995, Japanese Patent Application (OPI) Nos. 57836/85, 60643/85, 122940/85, 122942/85, and 235134/85, etc.

In the present invention, a transparent or opaque heat generating element used in case of adopting current heating as a means for heating can be prepared utilizing heretofore known techniques with respect to a resistance heat generator.

The resistance heat generator includes a method utilizing a thin layer of an inorganic material exhibiting a property of semiconductor and a method utilizing a thin layer of an organic material composed of electrically conductive fine particles dispersed in a binder. The materials which can be employed in the former method include silicon carbide, molybdenum silicide, lanthanum chromate, barium titanate ceramics used as a PTC thermistor, tin oxide, zinc oxide, etc. The materials can be used to prepare a transparent or opaque thin layer in a known manner. With the latter method, electrically conductive fine particles such as metallic fine particles, carbon black, graphite, etc. are dispersed in a binder such as rubber, a synthetic polymer, gelatin, etc., to prepare a resistor having a desired temperature characteristic. The resistor may be either directly brought into contact with the light-sensitive element or separated by a support or an intermediate layer, etc.

Possible relationships of the positions of the heat generating element and the light-sensitive element are illustrated below.

Heat generating element/support/light-sensitive element

Support/heat generating element/light-sensitive element

Support/heat generating element/intermediate layer/light-sensitive element

Support/light-sensitive element/heat generating element

Support/light-sensitive element/intermediate layer/-heat generating element

A protective layer, an intermediate layer, a subbing layer, a back layer and other layers can be produced by preparing each coating solution and applying to a support by various coating methods such as a dip coating method, an air-knife coating method, a curtain coating method or a hopper coating method as described in U.S. Pat. No. 3,681,294 and drying in the same manner as used in preparing the light-sensitive layer or the dye fixing layer according to the present invention, by which the light-sensitive material is obtained.

If necessary, two or more layers may be applied at the same time by the method as described in U.S. Pat. No. 2,761,791 and British Pat. No. 837,095, etc.

As light sources of imagewise exposure in order to record images on the heat-developable light-sensitive material, radiation including visible light can be utilized. Generally, light sources used for conventional color prints can be used, examples of which include tungsten lamps, mercury lamps, halogen lamps such as iodine lamps, xenon lamps, laser light sources, CRT light sources, fluorescent tubes, light emitting diodes (LED), etc.

As heating means used in the development and transfer step in the present invention, a heat generator, a hot plate, an iron, a hot roller, a radiation ray such as an infrared ray, an ultrasonic wave, high-frequency heating, etc., as described above can be utilized.

In the method of the present invention, the transfer of mobile dyes accompanied by method in which development and transfer are carried out at the same time, as described in Japanese Patent Application (OPI) No. 218443/84, can be employed.

In the present invention, the dye providing substance which releases imagewise a mobile dye is used and a dye transfer assistant may be employed for the purpose of the transfer of dyes from the light-sensitive layer to the dye fixing layer.

The dye transfer assistant suitably used in a process wherein it is supplied from the outside include water and an aqueous solution containing sodium hydroxide, potassium hydroxide, an inorganic alkali metal salt or an organic base. The bases as used include those described for the image forming accelerator illustrated hereinbefore. Further, a solvent having a low boiling point such as methanol, N,N-dimethylformamide, acetone, diisobutyl ketone, etc., and a mixture of such a solvent having a low boiling point with water or an alkaline aqueous solution can be used. The dye transfer assistant may be used according to a process wherein the dye fixing material, the light-sensitive material or both thereof is wetted with the transfer assistant.

When the dye transfer assistant is incorporated into the light-sensitive material or the dye fixing material, it is not necessary to supply the transfer assistant from the outside. In this case, the above described dye transfer assistant may be incorporated into the material in the form of water of crystallization or microcapsules or as a precursor which releases the dye transfer assistant at a high temperature.

More preferred is a process wherein a hydrophilic thermal solvent which is solid at a normal temperature and melts at a high temperature is incorporated into the light-sensitive material or the dye fixing material. The hydrophilic thermal solvent can be incorporated either into any of the light-sensitive material and the dye fixing material or into both of them. Although the solvent can be incorporated into any of the emulsion layer, the intermediate layer, the protective layer, and the dye fixing layer, it is preferred to incorporate it into the dye fixing layer and/or a layer adjacent thereto.

Examples of the hydrophilic thermal solvents include ureas, pyridines, amides, sulfonamides, imides, alcohols, oximes and other heterocyclic compounds.

In the method in which development and transfer are conducted simultaneously or successively as described in detail in Japanese Patent Application (OPI) No. 218443/84, the image forming accelerator and/or the dye transfer assistant can be previously incorporated into either the dye fixing material, the light-sensitive material or both thereof, or can be supplied from the outside. In the method in which development and transfer are carried out simultaneously or successively, the heating temperature is generally 50° C. or higher, and preferably 60° C. or higher, and the temperature of a boiling point of the solvent to be used for transfer or lower. For instance, when the transfer solvent is water, a temperature range from 60° C. to 100° C. is desirable.

For the addition of the dye transfer assistant to the light-sensitive layer and/or the dye fixing layer, various means may be utilized, such as, for example, a roller coating method or a wire bar coating method as described in Japanese Patent Application (OPI) No. 55907/83; a method wherein water is coated on the surface of the dye-fixing material by the use of a water absorptive material as described in Japanese Patent Application ((OPI) No. 181347/84; a method wherein beads are formed between the heat-developable light-sensitive material and the dye fixing material and the dye transfer assistant is imparted thereto as described in Japanese Patent Application (OPI) No. 181346/84; a method wherein beads are formed between a water repellant roller and the dye fixing material and the dye transfer assistant is imparted thereto as described in Japanese Patent Application (OPI) No. 181348/84; and other dip methods, extrusion methods, a jetting method in which the dye transfer assistant is jetted from small orifices, a method in which pods including the dye transfer assistant are crushed, and other conventional means.

Regarding the amount of dye transfer assistant added to the material, a previously determined amount of the dye transfer assistant may be added, as described in Japanese Patent Application (OPI) No. 164551/84, or alternatively, an excess and sufficient amount of the dye transfer assistant is added and thereafter the amount may be appropriately regulated by squeezing any unnecessary amount of the assistant from the material by the use of rollers or the like under pressure or by evaporating the agent under heat.

For example, a method wherein the dye transfer assistant, for example, water is imparted to the dye fixing material in the manner as described above, the dye fixing material is passed through rollers under pressure to remove excess amount of the dye transfer assistant by squeezing and then it is superimposed to the heat-developable light-sensitive material can be employed.

The heat-developable light-sensitive material and the dye-fixing material are brought into intimate contact under a pressure of from 0.1 to 100 kg/cm$^2$, and preferably from 1 to 50 kg/cm$^2$, as described, e.g., in Japanese Patent Application (OPI) No. 180547/84, though varying depending on the embodiment and the material used. The pressure can be applied to the heat-developable light-sensitive material and the dye fixing material various known manners, such as passing through a pair of rollers, pressing using smooth plates and the like. The roller or plate used for pressure application can be heated to a temperature of from room temperature to that employed in the heat development step.

In accordance with the method of forming an image of the present invention, images having a high density and low fog are obtained in a short period of time by heating a light-sensitive material comprising a support having thereon at least a light-sensitive silver halide, a dye providing substance, a binder and an acetylene silver compound simultaneously with or after imagewise exposure thereof in the presence of water and a base and/or a base precursor, and transferring a diffusible dye thus formed or released to a dye fixing layer.

The present invention will be explained in greater detail with reference to the following examples, but the present invention should not be construed as being limited thereto.

EXAMPLE 1

A method of preparing a dispersion of acetylene silver compound is described below.

20 g of gelatin and 4.6 g of 4-acetylaminophenylacetylene were dissolved in a mixture of 1,000 ml of water and 200 ml of ethanol and the solution was maintained at 40° C. with stirring. A solution of 4.5 g of silver nitrate dissolved in 200 ml of water was added to the above prepared solution over 5 minutes. The thus prepared dispersion was adjusted in pH, precipitated and freed of excess salts. It was then adjusted to pH 6.3, whereby 300 g of a dispersion of Acetylene Silver Compound (8) was obtained.

Further, dispersions of Acetylene Silver Compounds (6), (18) and (35) were prepared in the same manner as described above, respectively.

A method for preparing a silver benzotriazole emulsion is described below.

28 g of gelatin and 13.2 g of benzotriazole were dissolved in 3,000 ml of water and the solution was maintained at 40° C. with stirring. A solution of 17 g of silver nitrate dissolved in 100 ml of water was added to the above prepared solution over 2 minutes. The thus prepared silver benzotriazole emulsion was adjusted in pH, precipitated, and freed of excess salts. It was then adjusted to a pH of 6.30, whereby 400 g of a silver benzotriazole emulsion was obtained.

A method for preparing a silver halide emulsion is described below.

To an aqueous solution of gelatin (prepared by dissolving 20 g of gelatin and 3 g of sodium chloride in 1,000 ml of water and maintained at 75° C.) were added simultaneously 600 ml of an aqueous solution containing sodium chloride and potassium bromide and an aqueous solution of silver nitrate (prepared by dissolving 0.59 moles of silver nitrate in 600 ml of water) over 40 minutes at an equal addition amount rate while stirring thoroughly. Thus, a mono-dispersed silver chlorobromide emulsion (bromide content: 80 mol%; crystal form: cubic; average grain size: 0.35 μm) was prepared.

After washing with water and desalting, 5 mg of sodium thiosulfate and 20 mg of 4-hydroxy-6-methyl-1,3,3a,7-tetrazaindene were added and then it was subjected to chemical sensitization at 60° C. The yield of the emulsion was 600 g.

A method of preparing a gelatin dispersion of a dye providing substance is described below.

A mixture of 5 g of Magenta Dye Providing Substance (A) described below, 0.5 g of succinic acid 2-ethylhexyl ester sulfonic acid sodium salt as a surface active agent, 10 g of tri-iso-nonyl phosphate and 30 ml of ethyl acetate was dissolved by heating at about 60° C. to prepare an uniform solution. This solution was mixed with 100 g of a 10% aqueous solution of lime-processed gelatin with stirring and the mixture was dispersed by means of a homogenizer at 10,000 rpm for 10 minutes. The dispersion thus obtained was designated as the dispersion of magenta dye providing substance.

Magenta Dye Providing Substance (A)

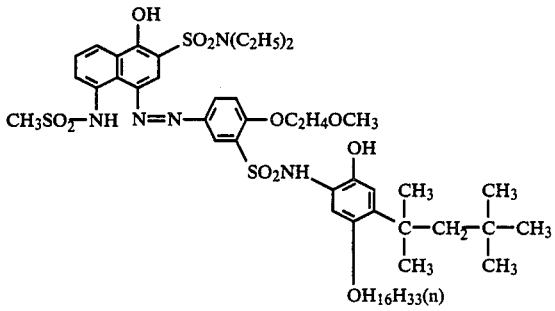

In the following, a method of preparing a light-sensitive coating composition is described.

| | | |
|---|---|---|
| (a) | Silver benzotriazole emulsion | 10 g |
| (b) | Light-sensitive silver chlorobromide emulsion | 15 g |
| (c) | Dispersion of dye providing substance | 25 g |
| (d) | 5% Aqueous solution of a compound having the following formula: | 5 ml |

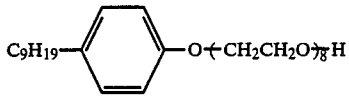

| | | |
|---|---|---|
| (e) | 10% Methanol solution of benzenesulfonamide | 5 ml |
| (f) | 0.04% Methanol solution of a dye having the following formula: | 4 ml |

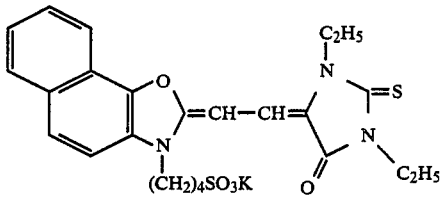

The above components (a) to (f) were mixed, and to the mixture were added a viscosity imparting agent and water to make the total volume to 100 ml. The resulting coating composition was coated on a polyethylene terephthalate film having a thickness of 180 μm at a wet layer thickness of 50 μm.

Then, the following coating composition for a protective layer was prepared.

| | | |
|---|---|---|
| (g) | 10% Aqueous solution of gelatin | 400 g |
| (h) | 4% Aqueous solution of a hardening agent having the following formula: $CH_2{=}CHSO_2CH_2CONH(CH_2)_2NHCOCH_2SO_2CH{=}CH_2$ | 50 ml |

The above components (g) and (h) were mixed and to the mixture were added a viscosity imparting agent and water to make the total volume of 1,000 ml. The resulting coating composition was coated on the above described light-sensitive layer at a wet layer thickness of 30 μm and dried. The light-sensitive material thus prepared was designated Light-Sensitive Material 101.

Light-Sensitive Material 102 was prepared in the same manner as described for Light-Sensitive Material 101, except using the dispersion of Acetylene Silver Compound (8) in place of the silver benzotriazole emulsion so as to provide the same silver coating amount.

Further, Light-Sensitive Materials 103, 104, and 105 were prepared in the same manner as described for Light-Sensitive Material 101, except using the dispersions of Acetylene Silver Compounds (6), (18) and (35) in place of the sivler benzotriazole emulsion, respectively.

A method of preparing a dye fixing material is described below.

10 g of poly(methyl acrylate-co-N,N,N-trimethyl-N-vinylbenzylammonium chloride) (molar ratio of methyl acrylate to vinylbenzylammonium chloride was 1/1) was dissolved in 200 ml of water and then uniformly mixed with 100 g of a 10% aqueous solution of lime-processed gelatin. The resulting mixture was uniformly coated at a wet layer thickness of 90 μm on a paper support laminated with polyethylene containing titanium dioxide dispersed therein.

On the thus formed layer was further coated a solution prepared by dissolving a mixture of 6 g of guanidine carbonate, 16 ml of water, 20 g of a 10% aqueous solution of gelatin, 4.8 ml of a 1% aqueous solution of succinic acid 2-ethylhexyl ester sulfonic acid sodium salt and 2 ml of a 2% aqueous solution of 2,4-dichloro-6-hydroxy-1,3,5-triazine at a wet layer thickness of 30 μm and dried. The thus prepared material was used as a dye fixing material having a mordant layer.

The light-sensitive material described above was imagewise exposed through a green filter for 1 second at 2,000 lux using a tungsten lamp.

The exposed light-sensitive material was supplied with 20 ml/m$^2$ of water on its emulsion layer side using a wire bar and then it was superimposed on the dye fixing material in such a manner that their coated layers were in contact with each other. After heating for 20 seconds using a heat roller which was adjusted so as to render the temperature of the water-adsorbed layer at 90° C. to 95° C., the dye fixing material was peeled apart from the light-sensitive material, whereupon a clear magenta image was obtained in the dye fixing material.

The maximum density and the minimum density of the resulting image were measured using a Macbeth reflection densitometer (RD-519). The results thus obtained are shown in Table 1.

TABLE 1

| Light-Sensitive Material No. | Organic Silver Compound | Maximum Density | Minimum Density |
|---|---|---|---|
| 101 (Comparison) | Silver benzotriazole | 1.73 | 0.11 |
| 102 (Present Invention) | Compound (8) | 2.28 | 0.15 |
| 103 (Present Invention) | Compound (6) | 2.12 | 0.12 |
| 104 (Present Invention) | Compound (18) | 2.19 | 0.14 |
| 105 (Present Invention) | Compound (35) | 2.16 | 0.13 |

From the results shown in Table 1, it is understood that by the method of forming an image using the light-sensitive material containing the acetylene silver compound according to the present invention, images having a high density and low fog can be rapidly obtained.

EXAMPLE 2

On a polyethylene terephthalate film support were coated a first layer (undermost layer) to a sixth layer (uppermost layer) as shown below to prepare a color light-sensitive material having a multilayer structure which was designated Light-Sensitive Material 201. In the following table, the coating amount of each component is set forth in parentheses.

| | |
|---|---|
| Sixth Layer | Gelatin (800 mg/m$^2$), Hardening agent*3 (16 mg/m$^2$), Silica*5 (100 mg/m$^2$) |
| Fifth Layer (Green-sensitive emulsion layer) | Silver chlorobromide emulsion (bromide: 50 mol %, silver: 400 mg/m$^2$), Benzenesulfonamide (180 mg/m$^2$), Silver benzotriazole emulsion (silver: 100 mg/m$^2$), Sensitizing dye D-1 (1 × 10$^{-6}$ mol/m$^2$), Hardening agent*3 (16 mg/m$^2$), Yellow dye providing substance (B) (400 mg/m$^2$), Gelatin (1,000 mg/m$^2$), Solvent having a high boiling point*4 (800 mg/m$^2$), Surface active agent*2 (100 mg/m$^2$) |
| Fourth Layer (Intermediate) Layer | Gelatin (800 mg/m$^2$), Hardening agent*3 (18 mg/m$^2$ |
| Third Layer (Red-sensitive emulsion layer) | Silver chlorobromide emulsion (bromide: 80 mol %, silver: 300 mg/m$^2$), Benzenesulfonamide (180 mg/m$^2$), Silver benzotriazole emulsion (silver: 100 mg/m$^2$), Sensitizing dye D-2 (8 × 10$^{-7}$ mol/m$^2$), Hardening agent*3 (18 mg/m$^2$), Magenta dye providing substance (A) (400 mg/m$^2$), Gelatin (1,000 mg/m$^2$), Solvent having a high boiling point*1 (600 mg/m$^2$), Surface active agent*2 (100 mg/m$^2$) |
| Second Layer (Intermediate layer) | Gelatin (800 mg/m$^2$), Hardening agent*3 (16 mg/m$^2$) |
| First Layer (Infrared-sensitive emulsion layer) | Silver chlorobromide emulsion (bromide: 50 mol %, silver: 300 mg/m$^2$), Benzenesulfonamide (180 mg/m$^2$), Silver benzotriazole emulsion (Silver: 100 mg/m$^2$), Sensitizing dye D-3 (1 × 10$^{-8}$ mol/m$^2$), Hardening agent*3 (16 mg/m$^2$), Cyan dye providing substance (C) (300 mg/m$^2$), Gelatin (1,000 mg/m$^2$), Solvent having a high boiling point*4 (600 mg/m$^2$), Surface active agent*2 (100 mg/m$^2$) |

Support

*1Tricresyl phosphate

*2 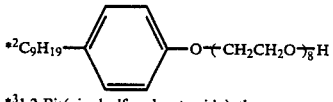

*3 1,2-Bis(vinylsulfonylacetamido)ethane

*4 (iso-$C_9H_{19}O)_3P{=}O$

*5 Size: 4 μm

Sensitizing Dye D-1

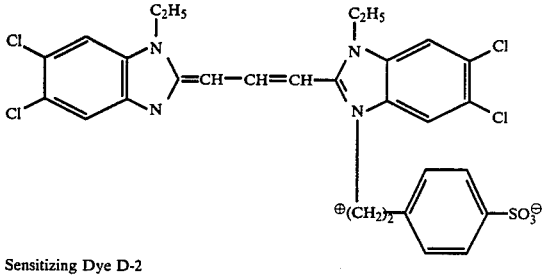

Sensitizing Dye D-2

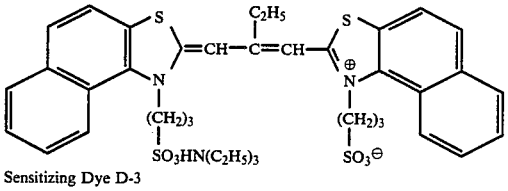

Sensitizing Dye D-3

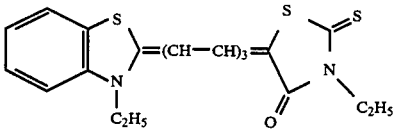

A method of preparing the silver halide emulsion for the fifth layer and the first layer is described in the following.

To an aqueous solution of gelatin (prepared by dissolving 20 g of gelatin and 3 g of sodium chloride in 1,000 ml of water and maintained at 75° C.) were added simultaneously 600 ml of an aqueous solution containing sodium chloride and potassium bromide and an aqueous solution of silver nitrate (prepared by dissolving 0.59 mole of silver nitrate in 600 ml of water) over 40 minutes at an equal addition amount rate while stirring thoroughly. Thus, a mono-dispersed silver chlorobromide emulsion (bromide content: 50 mol%; crystal form: cubic; average grain size: 0.40 μm) was prepared.

After washing with water and desalting, 5 mg of sodium thiosulfate and 20 mg of 4-hydroxy-6-methyl-1,3,3a,7-tetraazaindene were added, and then it was subjected to chemical sensitization at 60° C. The yield of the emulsion was 600 g.

Methods of preparing the silver halide emulsion for the third layer and the silver benzotriazole emulsion were the same as those described in Example 1.

A method of preparing a gelatin dispersion of dye providing substance is described in the following.

A mixture of 5 g of Yellow Dye Providing Substance (B) described below, 0.5 g of succinic acid 2-ethylhexyl ester sulfonic acid sodium salt, as a surface active agent, 10 g of tri-iso-nonyl phosphate and 30 ml of ethyl acetate was dissolved by heating at about 60° C. to prepare a uniform solution. This solution was mixed with 100 g of a 10% aqueous solution of lime-processed gelatin with stirring and the mixture was dispersed by means of a homogenizer at 10,000 rpm for 10 minutes. The dispersion thus obtained was designated as a dispersion of yellow dye providing substance.

A dispersion of magenta dye providing substance was prepared in the same manner as described above except using Magenta Dye Providing Substance (A) described in Example 1 and using 7.5 g of tricresyl phosphate as an organic solvent having a high boiling point.

Further, a dispersion of cyan dye providing substance was prepared in the same manner for the dispersion of yellow dye providing substance as described above, except using Cyan Dye Providing Substance (C) described below.

Yellow Dye Providing Substance (B)

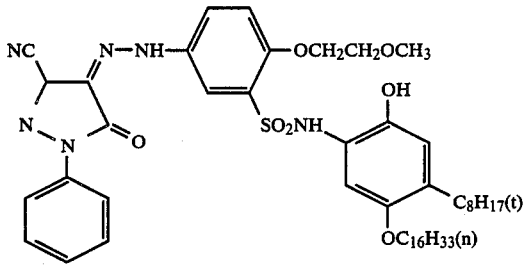

Cyan Dye Providing Substance (C)

-continued

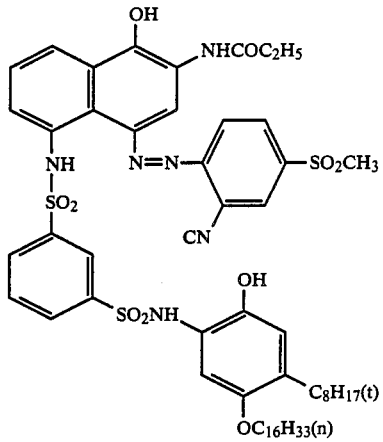

Light-Sensitive Materials 202, 203, 204, and 205 were prepared in the same manner as described for Light-Sensitive Material 201, except using the dispersions of Acetylene Silver Compounds (8), (6), (18), and (35) according to the present invention same as in Example 1 in a silver coating amount of 100 mg/m$^2$ in place of the silver benzotriazole emulsions employed in the first layer, the third layer, and the fifth layer, respectively.

The above described multilayer color light-sensitive materials were exposed through a three color separation filter of G, R, and IR (G: filter transmitting a band of 500 nm to 600 nm; R: filter transmitting a band of 600 nm to 700 nm; IR: filter transmitting a band of 700 nm or more), the density of which continuously changes, for 1 second at 500 lux using a tungsten lamp.

The exposed light-sensitive materials were supplied with 20 ml/m$^2$ of water on the emulsion layer side thereof using a wire bar and then it was superimposed on the dye fixing material in such a manner that their coated layers were in contact with each other as described in Example 1. After heating for 15 seconds or 20 seconds using a heat roller which was adjusted so as to render the temperature of the water-adsorbed layer at 90° C. to 95° C., the dye fixing material, whereupon yellow, magenta, and cyan color images were obtained in the dye fixing material corresponding to the three color separation filter of G (green), R (red), and IR (infrared), respectively.

The maximum density (Dmax) and the minimum density (Dmin) of each color were measured using a Macbeth reflection densitometer (RD-519).

The results thus obtained are shown in Table 2.

TABLE 2

| Light-Sensitive Material No. | Organic Silver Compound | Processing Time | Dmax | | | Dmin | | |
|---|---|---|---|---|---|---|---|---|
| | | | Yellow | Magenta | Cyan | Yellow | Magenta | Cyan |
| 201 (Comparison) | Silver benzotriazole | 15 | 0.9 | 0.8 | 0.6 | 0.10 | 0.10 | 0.11 |
| (Comparison) | Silver benzotriazole | 20 | 1.8 | 1.7 | 1.7 | 0.11 | 0.11 | 0.12 |
| 202 (Present Invention) | Compound (8) | 15 | 1.8 | 2.3 | 2.4 | 0.11 | 0.12 | 0.12 |
| (Present Invention) | Compound (8) | 20 | 2.1 | 2.3 | 2.4 | 0.14 | 0.13 | 0.13 |
| 203 (Present Invention) | Compound (6) | 15 | 1.7 | 2.2 | 2.2 | 0.10 | 0.11 | 0.11 |
| (Present Invention) | Compound (6) | 20 | 1.9 | 2.4 | 2.4 | 0.13 | 0.12 | 0.12 |
| 204 (Present Invention) | Compound (18) | 15 | 1.9 | 2.3 | 2.2 | 0.12 | 0.12 | 0.13 |
| (Present Invention) | Compound (18) | 20 | 2.2 | 2.3 | 2.4 | 0.14 | 0.13 | 0.14 |

TABLE 2-continued

| Light-Sensitive Material No. | Organic Silver Compound | Processing Time | Dmax Yellow | Dmax Magenta | Dmax Cyan | Dmin Yellow | Dmin Magenta | Dmin Cyan |
|---|---|---|---|---|---|---|---|---|
| 205 (Present Invention) | Compound (35) | 15 | 1.8 | 2.1 | 2.3 | 0.12 | 0.12 | 0.13 |
| (Present Invention) | Compound (35) | 20 | 2.1 | 2.3 | 2.4 | 0.14 | 0.14 | 0.14 |

From the results shown in Table 2, it is understood that the image having a high density and low fog are obtained rapidly by means of the method of forming an image according to the present invention, in which the light-sensitive material containing the acetylene silver compound is employed.

EXAMPLE 3

A method for preparing a silver halide emulsion is described in the following.

40 g of gelatin and 26 g of potassium bromide (KBr) were dissolved in 3,000 ml of water and the solution was maintained at 50° C. with stirring. A solution of 34 g of silver nitrate dissolved in 200 ml of water was added to the above-prepared solution over a 10 minute period. Then, a solution of 3.3 g of potassium iodide (KI) dissolved in 100 ml of water was added over a 2 minute period. The thus-prepared silver iodobromide emulsion was adjusted in pH, precipitated, and freed of excess salts. It was then adjusted to a pH of 6.0, whereby 400 g of a silver iodobromide emulsion was obtained.

A method of preparing a gelatin dispersion of a dye providing substance is described below.

A mixture of 10 g of Dye Providing Substance (D) described below, 0.5 g of succinic acid 2-ethylhexyl ester sulfonic acid sodium salt, as a surface active agent, 20 g of tricresyl phosphate (TCP), and 30 ml of ethyl acetate was dissolved by heating at about 60° C. to prepare a solution. This solution was mixed with 100 g of a 10% aqueous solution of gelatin with stirring and the mixture was dispersed by means of a homogenizer at 10,000 rpm for 10 minutes. The dispersion thus obtained was designated as the dispersion of the dye providing substance.

Dye Providing Substance (D)

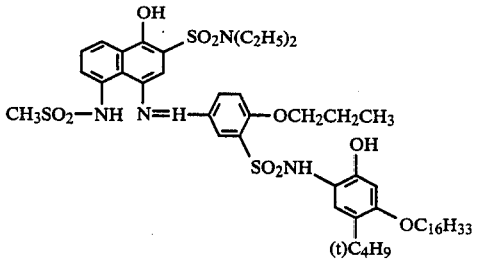

In the following, a method for preparing a light-sensitive coating composition is described.

| | | |
|---|---|---|
| (a) | Light-sensitive silver iodobromide emulsion | 25 g |
| (b) | Dispersion of dye providing substance | 33 g |
| (c) | 5% Aqueous solution of a compound having the following formula: | 10 ml |

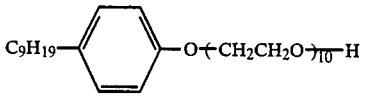

-continued

| | | |
|---|---|---|
| (d) | Solution of 0.4 g of $(CH_3)_2NSO_2NH_2$ dissolved in 4 ml of methanol | |

The above components (a) to (d) were mixed and dissolved by heating. The resulting solution was then coated on a polyethylene terephthalate film having a thickness of 180 μm, at a wet layer thickness of 30 μm, and then dried. On the thus formed layer was further coated the following coating composition at a wet layer thickness of 25 μm, to thereby form a protective layer.

Composition of Protective Layer:

| | | |
|---|---|---|
| (e) | 10% Aqueous solution of gelatin | 30 g |
| (f) | 4% Aqueous solution of a hardening agent having the following formula: $CH_2{=}CHSO_2CH_2CONH(CH_2)_2NHCOCH_2SO_2CH{=}CH_2$ | 8 ml |
| (g) | Water | 70 ml |

The light-sensitive material thus prepared was designated Light-Sensitive Material 301.

Light-Sensitive Materials 302, 303, 304, and 305 were prepared in the same manner as described for Light-Sensitive Material 301, except that 10% of the silver coating amount of the silver iodobromide emulsion was replaced with the dispersion of Acetylene Silver Compounds (8), (6), (18), and (35) according to the present invention, i.e., the same as used in Example 1, respectively.

The light-sensitive materials were exposed imagewise for 10 seconds using a tungsten lamp at 2,000 lux, and then subjected to the same procedure as described in Example 1, whereupon a negative magenta color image was obtained in the dye fixing material.

The densities of the negative color image were measured using a Macbeth reflection densitometer (RD-519). The results thus obtained are shown in Table 3.

TABLE 3

| Light-Sensitive Material No. | Acetylene Silver Compound | Processing Time (sec) | Maximum Density | Minimum Density |
|---|---|---|---|---|
| 301 (Comparison) | none | 15 | 0.70 | 0.11 |
| (Comparison) | none | 20 | 1.70 | 0.12 |
| 302 (Present Invention) | Compound (8) | 15 | 1.84 | 0.12 |
| (Present Invention) | Compound (8) | 20 | 2.23 | 0.14 |
| 303 (Present Invention) | Compound (6) | 15 | 1.72 | 0.11 |
| (Present Invention) | Compound (6) | 20 | 2.11 | 0.12 |
| 304 (Present Invention | Compound (18) | 15 | 1.80 | 0.12 |
| (Present Invention | Compound (18) | 20 | 2.21 | 0.13 |
| 305 (Present Invention) | Compound (35) | 15 | 1.90 | 0.13 |
| (Present | Compound | 20 | 2.30 | 0.15 |

TABLE 3-continued

| Light-Sensitive Material No. | Acetylene Silver Compound | Processing Time (sec) | Maximum Density | Minimum Density |
|---|---|---|---|---|
| Invention | (35) | | | |

From the results shown in Table 3, it is understood that the images having a high density and low fog are rapidly obtained by the method of forming an image using the light-sensitive material containing a small amount of the acetylene silver compound according to the present invention.

EXAMPLE 4

Method for preparation of silver benzotriazole emulsion containing light-sensitive silver bromide 6.5 g of benzotriazole and 10 g of gelatin were dissolved in 1,000 ml of water and the solution was maintained at 50° C. with stirring. A solution of 8.5 g of silver nitrate dissolved in 100 ml of water was added to the aboveprepared solution over a 2 minutes period. Then, a solution of 1.2 g of potassium bromide dissolved in 50 ml of water was added over a 2 minutes period. The thus-prepared emulsion was adjusted in pH, precipitated, and freed of excess salts. It was then adjusted to a pH of 6.0, whereby 200 g of a silver benzotriazole emulsion containing silver bromide was obtained.

Method for preparation of a gelatin dispersion of a dye providing substance

A mixture of 10 g of a dye providing substance having the structure shown below, 0.5 g of succinic acid 2-ethylhexyl ester sulfonic acid sodium salt, as a surface active agent, 4 g of tricresyl phosphate (TCP) and 20 ml of cyclohexanone was dissolved by heating at about 60° C. to prepare a uniform solution. This solution was mixed with 100 g of a 10% aqueous solution of lime-processed gelatin with stirring, and the mixture was dispersed by means of a homogenizer at 10,000 rpm for 10 minutes.

Dye Providing Substance

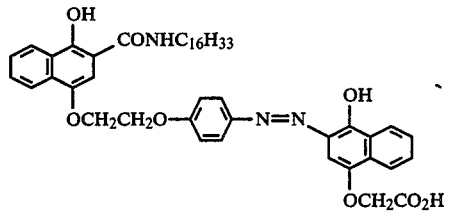

A method for preparing a light-sensitive coating composition is described below.

| | | |
|---|---|---|
| (a) | Silver benzotriazole emulsion containing light-sensitive silver bromide | 10 g |
| (b) | Dispersion of dye providing substance | 3.5 g |
| (c) | Gelatin (10% aqueous solution) | 5 g |
| (d) | Solution of 0.2 g of 2,6-dichloro-4-aminophenol dissolved in 2 ml of methanol | |
| (e) | 10% Aqueous solution of a compound having the following formula: | 1 ml |

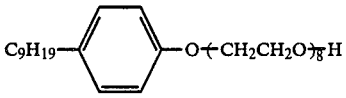

The above components (a) to (e) were mixed and dissolved by heating and the solution was coated on a polyethylene terephthalate film having a thickness of 180 μm at a wet layer thickness of 30 μm.

On the thus formed layer was further coated the solution having the components (f) to (k) described below at a wet layer thickness of 30 μm as a protective layer, followed by drying to prepare Light-Sensitive Material 401.

| | | |
|---|---|---|
| (f) | 10% Aqueous solution of gelatin | 30 ml |
| (g) | 4% Aqueous solution of a hardening agent having the following formula: $CH_2{=}CHSO_2CH_2CONH(CH_2)_2NHCOCH_2SO_2CH{=}CH_2$ | 8 ml |
| (h) | Water | 40 ml |

Further, Light-Sensitive Material 402 was prepared in the same manner as described for Light-Sensitive Material 401, except using an emulsion of Acetylene Silver Compound (8) containing light-sensitive silver bromide prepared in the manner as described below in place of the silver benzotriazole emulsion containing light-sensitive silver bromide.

Method for preparation of an emulsion of Acetylene Silver Compound (8) Containing Light-Sensitive Silver Bromide 8.7 g of 4-acetylaminophenylacetylene and 10 g of gelatin were dissolved in a mixture of 300 ml of ethanol and 1,000 ml of water and the solution was maintained at 50° C. with stirring. A solution of 8.5 g of silver nitrate dissolved in 100 ml of water was added to the above-described solution over a 2 minutes period. Then, a solution of 1.2 g of potassium bromide dissolved in 50 ml of water was added over a 2 minutes period. The thus-prepared emulsion was adjusted to pH, precipitated, and freed of excess salts. It was then adjusted to a pH of 6.0, whereby 200 g of an emulsion of Acetylene Silver Compound (8) containing light-sensitive silver bromide was obtained.

Light-Sensitive Materials 401 and 402 thus-prepared were exposed imagewise at 2,000 lux for 10 seconds using a tungsten lamp and then subjected to the same procedure as described in Example 1, whereupon a negative magenta color image was obtained in the dye fixing material.

The densities of the negative color image were measured using a Macbeth reflection densitometer (RD-519). The results thus obtained are shown in Table 4.

TABLE 4

| Light-Sensitive Material No. | Processing Time (sec) | Maximum Density | Minimum Density |
|---|---|---|---|
| 401 (Comparison) | 15 | 0.71 | 0.13 |
| (Comparison) | 20 | 1.20 | 0.15 |
| 402 (Present Invention) | 15 | 1.95 | 0.16 |
| (Present Invention) | 20 | 2.20 | 0.18 |

From the results shown in Table 4, it is understood that images having a high density and low fog are obtained rapidly according to the method of forming an image of the present invention, in which the light-sensitive material containing the acetylene silver compound is employed.

EXAMPLE 5

Method for preparation of a gelatin dispersion of a dye providing substance

A mixture of 5 g of a dye providing substance which is capable of being reduced having the structure shown below, 4 g of an electron donative substance having the structure shown below, 0.5 g of succinic acid 2-ethylhexyl ester sulfonic acid sodium salt, 10 g tricresyl phosphate (TCP) and 20 ml of cyclohexanone was dissolved by heating at about 60° C. to prepare a solution. This solution was mixed with 100 g of a 10% aqueous solution of gelatin with stirring and the mixture was dispersed by means of a homogenizer at 10,000 rpm for 10 minutes.

Dye Providing Substance:

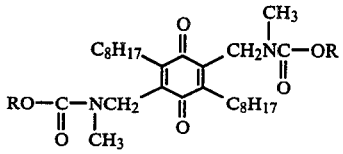

R:

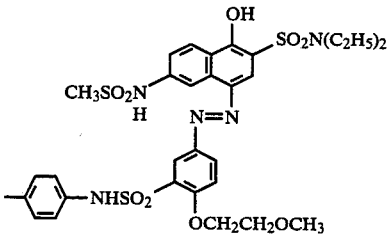

Electron Donative Substance:

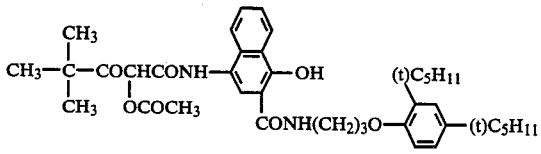

A method of preparing a light-sensitive coating composition is described in the following.

| | | |
|---|---|---|
| (a) | Silver benzotriazole emulsion containing light-sensitive silver bromide (same as described in Example 4) | 10 g |
| (b) | Dispersion of dye providing substance | 3.5 g |
| (c) | 5% Aqueous solution of a compound having the following formula: | 1.5 ml |

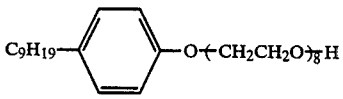

The above components (a) to (c) were mixed and dissolved by heating and the mixture was coated on a polyethylene terephthalate film at a wet layer thickness of 30 μm and dried.

On the thus formed layer was further coated a solution containing components (d) to (f) as described below at a wet layer thickness of 30 μm as a protective layer, followed by drying to prepare Light-Sensitive Material 501.

| | | |
|---|---|---|
| (d) | 10% Aqueous solution of gelatin | 30 g |
| (e) | 4% Aqeuous solution to a hardening agent having the following formula: $CH_2{=}CHSO_2CH_2CONH(CH_2)_2NHCOCH_2SO_2CH{=}CH_2$ | 8 ml |
| (f) | Water | 62 ml |

Further, Light-Sensitive Material 502 was prepared in the same manner as described for Light-Sensitive Material 501, except using the emulsion of Acetylene Silver Compound (8) containing light-sensitive silver bromide, i.e., the same as described in Example 4, in place of the silver benzotriazole emulsion containing light-sensitive silver bromide.

Light-Sensitive Materials 501 and 502 thus-prepared were exposed imagewise at 2,000 lux for 10 seconds using a tungsten lamp. Then, the same procedure as described in Example 1 was conducted using the dye fixing material as described in Example 1, whereby a positive magenta color image was obtained in the dye fixing material.

The densities of the positive color image were measured using a Macbeth reflection densitometer (RD-519). The results thus obtained are shown in Table 5.

TABLE 5

| Light-Sensitive Material No. | Processing Time (sec) | Maximum Density | Minimum Density |
|---|---|---|---|
| 501 (Comparison) | 15 | 0.80 | 0.17 |
| (Comparison) | 20 | 1.65 | 0.21 |
| 502 (Present Invention) | 15 | 1.90 | 0.16 |
| (Present Invention) | 20 | 2.11 | 0.21 |

From the results shown in Table 5, it is understood that by means of the method of forming an image according to the present invention, in which the light-sensitive material containing the acetylene silver compound is employed, the images having a high density and low fog are obtained rapidly in a system for forming a positive image.

These results set forth in the above examples clearly demonstrate the effects according to the present invention.

While the invention has been described in detail and with reference to specific embodiments thereof, it will be apparent to one skilled in the art that various changes and modifications can be made therein without departing from the spirit and scope thereof.

What is claimed is:

1. A method for forming an image comprising heating a light-sensitive material comprising a support having thereon at least a light-sensitive silver halide, a dye providing substance, a binder, and an acetylene silver compound, simultaneously with or after imagewise exposure thereof in the presence of water and at least one of a base and a base precursor, thereby transferring a diffusible dye thus formed or released to a dye fixing layer, wherein water is supplied to the dye-fixing layer, the light-sensitive material or both the dye-fixing layer and the light-sensitive material and then the dye-fixing material and the light-sensitive material are heated to heat develop the light-sensitive material and simultaneously transfer the diffusible dye thus formed or released to the dye-fixing layer.

2. A method for forming an image as in claim 1, wherein the dye fixing layer is provided on a support different from the support of the light-sensitive material, and the water is supplied from outside of the light-sensitive material or a dye fixing material containing the dye fixing layer.

3. A method for forming an image as in claim 1, wherein the amount of water is at least 0.1 times the total weight of the coated layers in the light-sensitive material and a dye fixing material containing the dye fixing layer.

4. A method for forming an image as in claim 3, wherein the amount of water is in a range of from 0.1 times the total weight of the coated layers to the weight of water corresponding to the maximum swelling volume of all coated layers.

5. A method for forming an image as in claim 4, wherein the amount of water is in a range of from 0.1 times the total weight of the coated layers to a value obtained by substracting the total weight of the coated layers from the weight of water corresponding to the maximum swelling volume of all coated layers.

6. A method for forming an image as in claim 1, wherein the heating is carried out at a pH in the light-sensitive layer of 12 or less.

7. A method for forming an image as in claim 6, wherein the heating is carried out at a pH in the light-sensitive layer of from 11 or less to a neutral range.

8. A method for forming an image as in claim 1, wherein the base has a pKa of 8 or more.

9. A method for forming an image as in claim 1, wherein the base and base precursor are incorporated into the light-sensitive material or a dye fixing material containing the dye fixing layer.

10. A method for forming an image as in claim 9, wherein the total amount of base and base precursor is 50% by weight or less based on the coated amount of the layer in which they are incorporated.

11. A method for forming an image as in claim 10, wherein the total amount of the base and base precursor is in a range of from 0.01% by weight to 40% by weight based on the coated amount of the layer in which they are incorporated.

12. A method for forming an image as in claim 1, wherein the base and base precursor are dissolved in water in a concentration ranging from 0.005 mol/l to 2 mol/l.

13. A method for forming an image as in claim 1, wherein the heating temperature is 50° C. or more.

14. A method for forming an image as in claim 1, wherein a light-sensitive layer containing a light-sensitive silver halide, a dye providing substance, a binder, and an acetylene silver compound, and the dye fixing layer are provided on the same support or different supports.

15. A method for forming an image as in claim 1, wherein the light-sensitive material is exposed imagewise and then heated in contact with a dye fixing material containing the dye fixing layer.

16. A method for forming an image as in claim 15, wherein the dye fixing material is separated from the light-sensitive material after the heating.

17. A method for forming an image as in claim 1, wherein the acetylene silver compound is represented by formula (I)

$$R—C{\equiv}C—Ag \qquad (I)$$

wherein R represents a substituted or unsubstituted alkyl group, a substituted or unsubstituted cycloalkyl group, a substituted or unsubstituted alkenyl group, a substituted or unsubstituted alkynyl group; a substituted or unsubstituted aralkyl group, a substituted or unsubstituted aryl group, or a substituted or unsubstituted heterocyclic group.

18. A method for forming an image as in claim 17, wherein R represents a substituted or unsubstituted phenyl group.

19. A method for forming an image as in claim 1, wherein the coated amount of the acetylene silver compound is in a range of from 0.01 mol to 200 mols per mol of the light-sensitive silver halide.

20. A method for forming an image as in claim 1, wherein the coated amount of the acetylene silver compound is in a range of from 10 mg/m$^2$ to 10 g/m$^2$, calculated as the amount of silver.

21. A method for forming an image as in claim 1, wherein the average particle size of the acetylene compound is 10 $\mu$m or less.

22. A method for forming an image as in claim 1, wherein the dye providing substance is a dye releasing compound which has reducing property itself.

23. A method for forming an image as in claim 1, wherein the light-sensitive material further contains a reducing agent.

24. A method for forming an image as in claim 23, wherein the amount of the reducing agent is in a range of from 0.01 mol to 20 mols per mol of silver.

25. A method for forming an image as in claim 1, wherein the light-sensitive material comprises a support having thereon at least three silver halide emulsion layers, each sensitive to a different spectral wavelength region.

* * * * *